US009448542B2

(12) United States Patent
Honda

(10) Patent No.: US 9,448,542 B2
(45) Date of Patent: Sep. 20, 2016

(54) ELECTRONIC TIMEPIECE

(71) Applicant: Seiko Epson Corporation, Tokyo (JP)

(72) Inventor: Katsuyuki Honda, Miyata-Mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/633,847

(22) Filed: Feb. 27, 2015

(65) Prior Publication Data

US 2015/0268634 A1 Sep. 24, 2015

(30) Foreign Application Priority Data

Mar. 20, 2014 (JP) ..... 2014-057393
Jul. 24, 2014 (JP) ..... 2014-151065

(51) Int. Cl.

| | |
|---|---|
| ***G04G 5/00*** | (2013.01) |
| ***G04G 21/04*** | (2013.01) |
| ***G04R 20/04*** | (2013.01) |
| ***G04F 8/00*** | (2006.01) |
| ***G04G 19/08*** | (2006.01) |

(52) U.S. Cl.

CPC ..... *G04R 20/04* (2013.01); *G04F 8/006* (2013.01); *G04G 19/08* (2013.01)

(58) Field of Classification Search

CPC ..... G04R 20/02; G04R 20/04; G04G 5/00; G04G 21/04; G04G 19/08; G04F 8/00; G04F 8/003; G04F 8/006; G04F 10/00; G04F 20/04

See application file for complete search history.

(56) References Cited

U.S. PATENT DOCUMENTS

| | | | | |
|---|---|---|---|---|
| 2004/0041570 | A1* | 3/2004 | Haeni | G04C 10/04 324/435 |
| 2009/0135674 | A1* | 5/2009 | Matsuzaki | G01S 19/14 368/14 |
| 2009/0189809 | A1* | 7/2009 | Baba | G01S 1/047 342/357.57 |
| 2011/0205853 | A1* | 8/2011 | Kamiyama | G04F 8/003 368/80 |
| 2012/0243383 | A1* | 9/2012 | Honda | G04R 20/04 368/47 |
| 2013/0051188 | A1* | 2/2013 | Akiyama | G04R 20/04 368/47 |
| 2013/0188460 | A1* | 7/2013 | Ihashi | G04B 99/00 368/66 |

FOREIGN PATENT DOCUMENTS

| | | | |
|---|---|---|---|
| JP | 06-174864 | A | 6/1994 |
| JP | 2004-138438 | A | 5/2004 |
| JP | 2010-096523 | A | 4/2010 |

* cited by examiner

*Primary Examiner* — Amy Cohen Johnson
*Assistant Examiner* — Matthew Powell

(57) ABSTRACT

An electronic timepiece includes a reception device that receives a satellite signal, a reception control section that activates the reception device to carry out a reception process, a chronograph section that measures time, an input device, and an action control section when detecting time measurement input operation performed on the input device for activating the chronograph section during the reception process carried out by the reception control section, terminates the action of the reception control section, and activates the chronograph section.

15 Claims, 11 Drawing Sheets

ELECTRONIC TIMEPIECE

BACKGROUND

1. Technical Field

The present invention relates to an electronic timepiece having a function of receiving a satellite signal transmitted from a position information satellite and a time measurement function and to a method for controlling the electronic timepiece.

2. Related Art

Among electronic timepieces of related art that receive a satellite signal transmitted from a GPS (global positioning system) to acquire time information and perform timekeeping in accordance with the acquired time information, some of the electronic timepieces have a chronograph function of measuring time (see JP-A-2010-96523, for example).

The GPS-based wristwatch described in JP-A-2010-96523 initiates reception of a satellite signal in a timing mode or a positioning mode in response to manual operation or automatically at predetermined timing. The wristwatch has not only a time display function using an hour hand, a minute hand, and a second hand but also a stopwatch function (chronograph function) of measuring elapsed time by using a 12-hour hand, a 30-minute hand, and a center hand.

In the GPS-based wristwatch described in JP-A-2010-96523, for example, there is a case where the satellite signal reception function and the chronograph function are simultaneously performed, such as a case where the chronograph function is performed in response to manual operation performed during automatically initiated satellite signal reception. Since performing the satellite signal reception function and the chronograph function is a large-load process in a battery-driven timepiece, simultaneously performing the two functions may temporarily lower the battery voltage in the timepiece and processing ability thereof or otherwise degrade the performance thereof, possibly resulting in improper operation of the functions, which means poor operability in some cases.

SUMMARY

An advantage of some aspects of the invention is to provide an electronic timepiece having a satellite signal reception function and a time measurement function and capable of improving usability and also provide a method for controlling the electronic timepiece.

An electronic timepiece according to an aspect of the invention includes a reception device that receives a satellite signal, a reception control section that activates the reception device to carry out a reception process, a time measurement section that measures time, an input device, and an action control section that, when detecting time measurement input operation performed on the input device for activating the time measurement section during the reception process carried out by the reception control section, terminates the action of the reception control section, and activates the time measurement section.

According to the aspect of the invention, when time measurement input operation is performed during the reception process carried out by the reception control section, the action control section terminates the action of the reception control section and activates the time measurement section.

As a result, the satellite signal reception process and the time measurement process are not performed at the same time, whereby a decrease in the battery voltage in the electronic timepiece or a decrease in the processing ability thereof can be suppressed, and the time measurement section can act correctly. The time measurement can therefore be reliably performed in accordance with input operation for improvement in usability.

In the electronic timepiece according to the aspect of the invention, it is preferable that the electronic timepiece further includes a display device, the reception control section, after terminating the reception process, carries out a reception result display process to cause the display device to display a result of the reception, and the action control section, when detecting the time measurement input operation during the reception result display process carried out by the reception control section, terminates the action of the reception control section and activates the time measurement section.

According to the aspect of the invention with this configuration, when the time measurement input operation is performed during the reception result display process carried out by the reception control section, the action control section terminates the action of the reception control section and activates the time measurement section, whereby the time measurement can be reliably performed in accordance with input operation. Further, when the display section is formed, for example, of an indication hand, a reception result and a time measurement result can be displayed by using the same indication hand, whereby the number of parts can be reduced and the size of the electronic timepiece can be reduced as compared with a case where separate indication hands are used to display the results.

In the electronic timepiece according to the aspect of the invention, it is preferable that the reception control section is an automatic reception control section that activates the reception device to carry out the reception process when an automatic reception condition under which the satellite signal is automatically received is satisfied.

According to the aspect of the invention with this configuration, when the time measurement input operation is performed during the reception process carried out by the automatic reception control section, the action control section terminates the action of the automatic reception control section and activates the time measurement section.

Since the reception process carried out by the automatic reception control section is automatically carried out without user's operation, the time measurement, which is performed based on input operation, has higher priority, whereby the electronic timepiece acts in accordance with user's intention for further improvement in usability.

In the electronic timepiece according to the aspect of the invention, it is preferable that the electronic timepiece further includes a manual reception control section that activates the reception device to carry out the reception process in accordance with input operation performed on the input device, and the action control section, even when detecting the time measurement input operation during the reception process carried out by the manual reception control section, allows the action of the manual reception control section to continue but does not activate the time measurement section.

When the time measurement input operation is performed during the reception process carried out by the manual reception control section in response to input operation, the time measurement input operation is likely to have been performed by user's accidental operation of the input device.

According to the aspect of the invention with this configuration, even when the time measurement input operation is performed during the reception process carried out by the manual reception control section in response to input operation, the action of the manual reception control section is allowed to continue but the time measurement section is not activated, whereby the electronic timepiece will not act against user's intention.

In the electronic timepiece according to the aspect of the invention, it is preferable that the automatic reception control section is activated when automatic reception timing is reached, the automatic reception timing is set at predetermined intervals, and the action control section, when detecting the time measurement input operation during the reception process carried out by the automatic reception control section after the automatic reception timing is reached, terminates the action of the automatic reception control section and sets the following automatic reception timing in such a way that the automatic reception is performed after a period shorter than the predetermined interval.

According to the aspect of the invention with this configuration, when the time measurement input operation is performed during the action of the automatic reception control section after the automatic reception timing is reached and the action of the automatic reception control section therefore is terminated, the reception process can then be carried out after a period shorter than the predetermined interval, whereby the reception interval will not be greatly longer (twice or further longer, for example) than the predetermined interval.

In the electronic timepiece according to the aspect of the invention, it is preferable that the action control section, even when detecting an instruction that initiates the reception process during the action of the time measurement section, allows the action of the time measurement section to continue but does not allow the reception process to start.

The action of the time measurement section is initiated in response to user's input operation, and the user can recognize that the time measurement section is in action, for example, because an indication hand for the time measurement moves during the action of the time measurement section. Therefore, when an instruction that initiates the reception process is issued during the action of the time measurement section, it is likely that the automatic reception condition is satisfied or the user's accidental input operation activates the manual reception control section. Further, the reception process can be carried out later, but the time measurement cannot be redone later once the measurement is completed.

Therefore, the configuration in which even when an instruction that initiates the reception process is detected during the action of the time measurement section, the action of the time measurement section is allowed to continue but the reception process is not allowed to start described above prevents action against user's intention from being performed.

In the electronic timepiece according to the aspect of the invention, it is preferable that the action control section, when detecting the instruction that initiates the reception process during the action of the time measurement section, allows the reception process to start after the action of the time measurement section is completed.

According to the aspect of the invention with this configuration, after the action of the time measurement section is completed, a satellite signal can be quickly and automatically received.

In the electronic timepiece according to the aspect of the invention, it is preferable that the electronic timepiece further includes a predetermined function section that performs a predetermined function in accordance with input operation performed on the input device, the action control section, even when detecting the time measurement input operation during the action of the predetermined function section, allows the action of the predetermined function section to continue but does not activate the time measurement section, and the predetermined function section terminates the action thereof in response to input operation performed on the input device for terminating the action of the predetermined function section.

When the time measurement input operation is performed during the action of the predetermined function section in response to input operation, the time measurement input operation is likely to have been performed by user's accidental operation of the input device.

According to the aspect of the invention with this configuration, even when the time measurement input operation is performed during the action of the predetermined function section in response to input operation, the action of the predetermined function section is allowed to continue but the time measurement section is not activated, whereby the electronic timepiece will not act against user's intention.

Further, the predetermined function section terminates the action thereof based on input operation that terminates the action of the predetermined function section. Therefore, even when the predetermined function section is in action, and the user desires to initiate the time measurement and performs relevant input operation, the user can immediately terminate the action of the predetermined function section and can activate the time measurement section, whereby the usability can be improved.

In the electronic timepiece according to the aspect of the invention, it is preferable that the electronic timepiece further includes a predetermined function section that performs a predetermined function in accordance with input operation performed on the input device, and the action control section, when detecting the time measurement input operation during the action of the predetermined function section, terminates the action of the predetermined function section and activates the time measurement section.

According to the aspect of the invention with this configuration, even when the predetermined function section is in action, and the user desires to initiate the time measurement and performs the time measurement input operation, the user can immediately terminate the action of the predetermined function section without separately performing input operation that terminates the action of the predetermined function section and can activate the time measurement section, whereby the usability can be improved.

In the electronic timepiece according to the aspect of the invention, it is preferable that the predetermined function section is at least one of a reception result display function section that displays a result of reception of the satellite signal, a leap second reception result display function section that displays a result of reception of leap second information contained in the satellite signal, and an automatic reception selection function section that selects whether the function of the automatic reception control section is enabled or disabled.

According to the aspect of the invention with this configuration, even when the time measurement input operation is performed during the action of any of the reception result display function section, the leap second reception result display function section, and the automatic reception selection function section in response to input operation, the action of the function section is allowed to continue and the time measurement section is not activated.

In the electronic timepiece according to the aspect of the invention, it is preferable that the reception control section is a manual reception control section that activates the reception device to carry out the reception process in accordance with input operation performed on the input device, and the action control section, when detecting the time measurement input operation during the reception process carried out by the manual reception control section, terminates the action of the manual reception control section and activates the time measurement section.

According to the aspect of the invention with this configuration, when the time measurement input operation is performed during the reception process carried out by the manual reception control section in response to input operation, the action control section terminates the action of the manual reception control section and activates the time measurement section.

Therefore, even when the reception process is carried out in response to input operation, and the user desires to initiate the time measurement and performs the time measurement input operation, the user can immediately perform the time measurement in response to the time measurement input operation without separately performing input operation that terminates the reception process, whereby the usability can be improved.

In the electronic timepiece according to the aspect of the invention, it is preferable that the action control section, when detecting the time measurement input operation during the reception process carried out by the reception control section, activates the time measurement section after the reception process carried out by the reception control section is completed.

According to the aspect of the invention with this configuration, since the time measurement section is activated after the reception process carried out by the reception control section is completed, it is possible to reliably prevent the reception process and the time measurement process from being performed at the same time, whereby a decrease in the battery voltage in the electronic timepiece or a decrease in the processing ability thereof can be reliably suppressed.

In the electronic timepiece according to the aspect of the invention, it is preferable that the action control section, when detecting the time measurement input operation during the reception process carried out by the reception control section, activates the time measurement section after causing the reception control section to initiate a reception termination process of terminating the reception process.

It is noted that it takes, for example, 100 msec from the initiation of the reception termination process to the termination of the reception process.

According to the aspect of the invention with this configuration, since the reception control section initiates the reception termination process and the time measurement section is then activated, the time measurement can be quickly performed in response to the time measurement input operation as compared, for example, with the case where the time measurement section is activated after the reception process is completed, whereby the usability can be improved.

Another aspect of the invention relates to a method for controlling an electronic timepiece including a reception device that receives a satellite signal and an input device, the method including a reception control step of activating the reception device to carry out a reception process, a time measurement step of measuring time, and an action control step of detecting time measurement input operation performed on the input device for executing the time measurement step during the reception process in the reception control step, terminating the reception control step, and executing the time measurement step.

In the aspect of the invention, the same advantageous effects as those provided by the electronic timepiece descried above can also be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Specific embodiments of the invention will be described below with reference to the drawings.

First Embodiment

Schematic Configuration of GPS Including Electronic Timepiece

Figure 1:
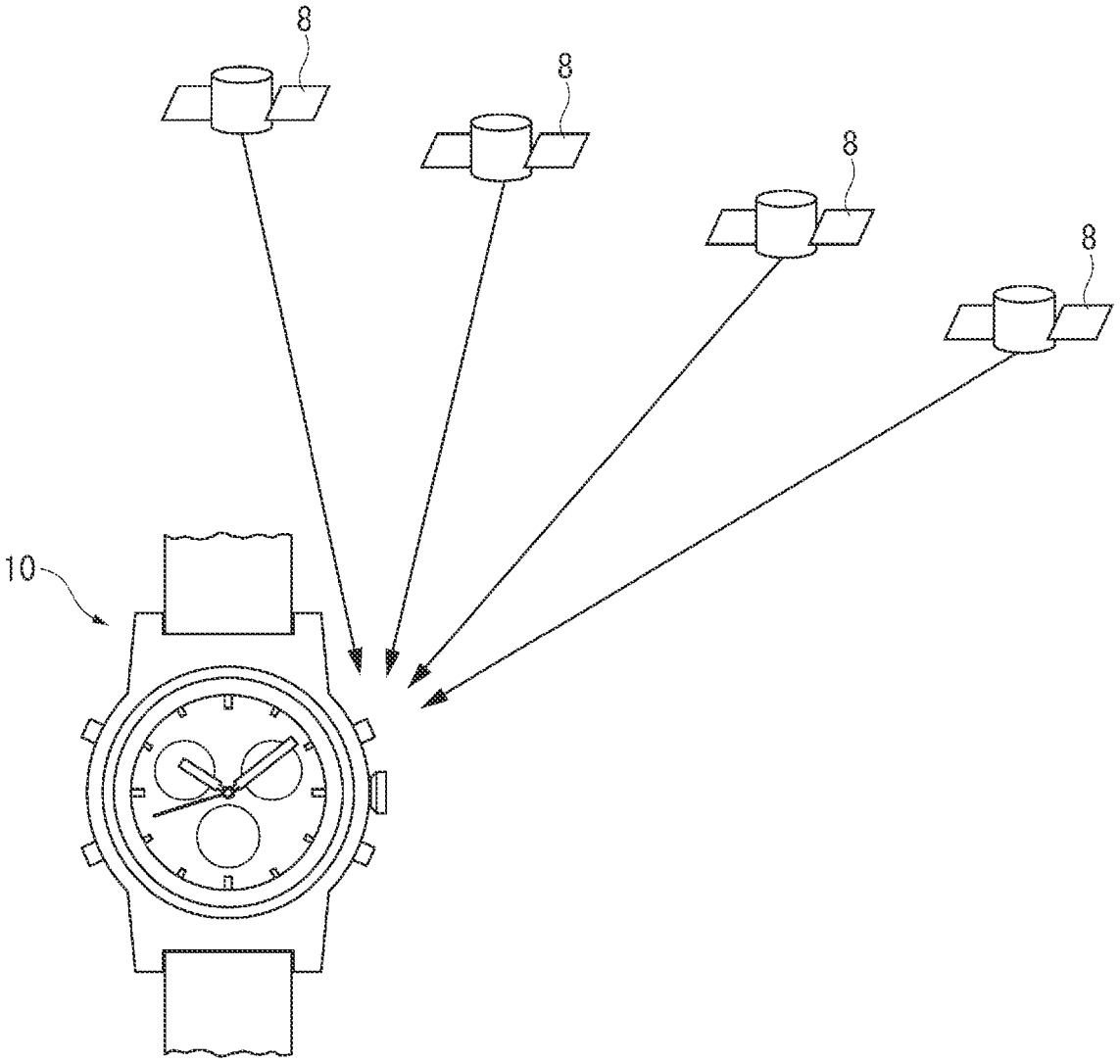
FIG. 1 is a schematic view showing an electronic timepiece according to a first embodiment of the invention.

FIG. 1 is a schematic view showing an electronic timepiece 10 according to a first embodiment. A description will first be made of a summary of a GPS in which the electronic timepiece 10 uses an external signal in the form of electrical radiation to determine position information on current location and time information.

The electronic timepiece 10 is a wristwatch that receives electrical radiation (satellite signal) from a GPS satellite 8 to correct internal time, and the electronic timepiece 10 displays time on the side (hereinafter referred to as "front side") of the timepiece that faces away from the side thereof in contact with an arm (hereinafter referred to as "rear side"). The GPS satellite 8 is a navigation satellite that goes along a predetermined orbit around the earth up in the sky and transmits 1.57542-GHz electrical radiation (L1 wave) with a navigation message superimposed thereon to the ground. In the following description, the 1.57542-GHz electrical radiation with a navigation message superimposed thereon is referred to as a satellite signal. The satellite signal is formed of a right-handed circularly polarized wave.

At present, approximately 31 GPS satellites 8 (FIG. 1 shows only 4 GPS satellites 8) are present. To allow the electronic timepiece 10 to identify which of the GPS satellites 8 has transmitted a satellite signal, each of the GPS satellites superimposes a specific pattern called a C/A code (coarse/acquisition code) formed of 1023 chips (each having a period of 1 ms) on the satellite signal. The C/A code, in which each of the chips is either +1 or −1, appears to be a random pattern. Examining correlation between a satellite signal and the pattern formed of each of the C/A codes therefore allows detection of the C/A code superimposed on the satellite signal.

Each of the GPS satellites 8 has an atomic clock incorporated therein, and a satellite signal contains very accurate GPS time information clocked by using the atomic clock. Further, a ground control segment measures a slight time error produced by the atomic clock incorporated in each of the GPS satellites 8, and the satellite signal also contains a time correction parameter for correction of the time error. The electronic timepiece 10 receives the satellite signal transmitted from one of the GPS satellites 8 and uses the GPS time information and the time correction parameter contained in the satellite signal to achieve correct time (time information), which is used as internal time.

The satellite signal further contains orbit information representing the on-orbit position of the GPS satellite 8. The electronic timepiece 10 can perform positioning calculation by using the GPS time information and the orbit information. The positioning calculation is performed on the assumption that the internal time of the electronic timepiece 10 contains an error to some extent.

That is, not only parameters x, y, and z for identification of the three-dimensional position of the electronic timepiece 10 but also the time error are unknown. The electronic timepiece 10 therefore typically receives satellite signals transmitted from at least four GPS satellites 8 and uses the GPS time information and the orbit information contained in the received satellite signals for the positioning calculation to determine position information on the current location.

Schematic Configuration of Electronic Timepiece

Figure 2:
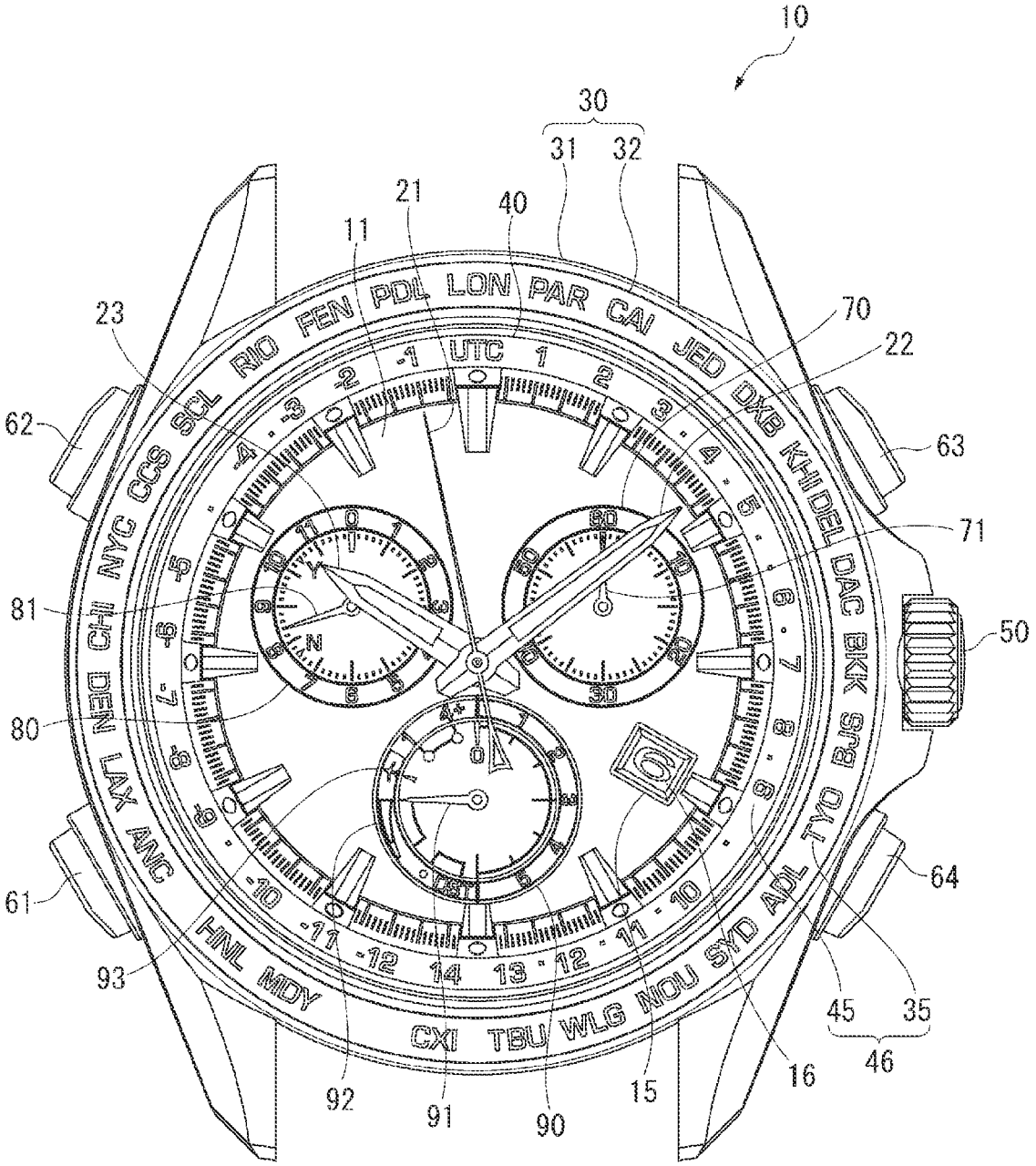
FIG. 2 is a plan view of the electronic timepiece viewed from the front side.
Figure 3:
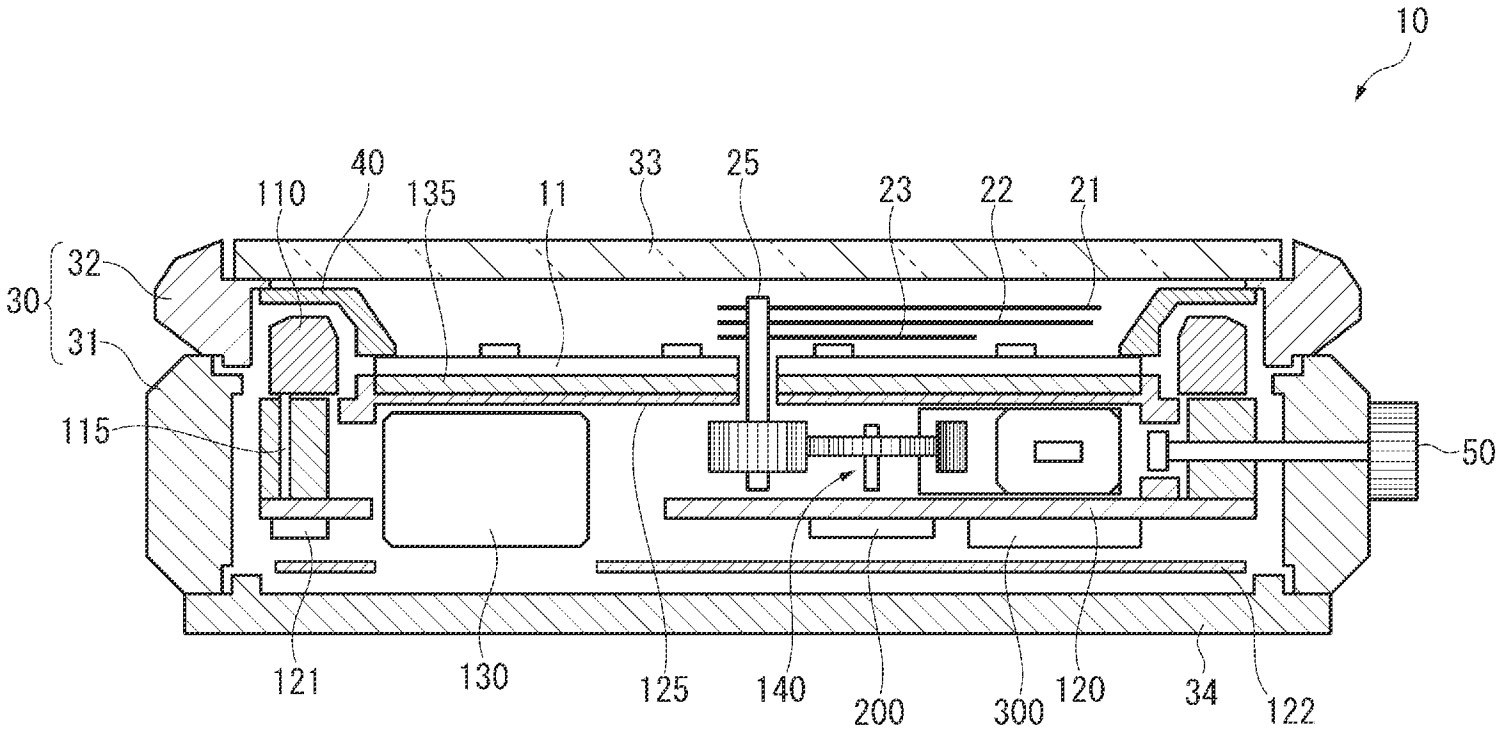
FIG. 3 is a cross-sectional view showing the electronic timepiece.

FIG. 2 is a plan view of the electronic timepiece viewed from the front side. FIG. 3 is a partial cross-sectional view schematically showing the electronic timepiece. The electronic timepiece 10 according to the present embodiment has a chronograph function.

The electronic timepiece 10 includes an exterior case 30, a cover glass plate 33, and a case back 34, as shown in FIGS. 2 and 3. The exterior case 30 is formed of a cylindrical case 31 made of a metal and a bezel 32 made of a ceramic material and fit into the case 31. A disk-shaped dial 11 is disposed as a time display portion inside the inner circumference of the bezel 32 with a ring-shaped dial ring 40, which is made of a plastic material, interposed between the dial 11 and the bezel 32.

The dial 11 is provided with indication hands 21, 22, and 23. The dial 11 is further provided with the following components with respect to the center of the dial: a circular first small window 70 and an indication hand 71 in the two-o'clock direction; a circular second small window 80 and an indication hand 81 in the ten-o'clock direction; a circular third small window 90 and an indication hand 91 in the six-o'clock direction; and a rectangular calendar small window 15 in the four-o'clock direction. The dial 11, the indication hands 21, 22, and 23, the first small window 70, the second small window 80, the third small window 90, the calendar small window 15, and other components are visible through the cover glass plate 33.

Further, a calendar wheel (date indicator) 16 is disposed on the rear side of the dial 11 and visible through the calendar small window 15.

The following components are provided on the side surface of the exterior case 30 with respect to the center of the dial 11: an A button 61 in a position along the eight-o'clock direction; a B button 62 in a position along the ten-o'clock direction; a C button 63 in a position along the two-o'clock direction; a D button 64 in a position along the four-o'clock direction; and a crown 50 in a position along the three-o'clock direction. When any of the A button 61, the B button 62, the C button 63, the D button 64, and the crown 50 is operated, an operation signal according to the operation is outputted.

In the electronic timepiece 10, the exterior case 30 made of a metal has two openings, with a front-side opening blocked with the cover glass plate 33 via the bezel 32 and a rear-side opening blocked with the case back 34 made of a metal, as shown in FIG. 3.

The following components are provided inside the exterior case 30: the dial ring 40, which is attached to the inner circumference of the bezel 32; the dial 11, which is light transmissive; an indication hand shaft 25, which passes through the dial 11; the indication hands 21, 22, and 23, which go around the indication hand shaft 25; a drive mechanism 140, which drives the indication hands 21, 22, and 23, indication hands 71, 81, and 91, which are not shown in FIG. 3, and the calendar wheel 16; and other components.

The indication hand shaft 25 is provided along the central axis of the exterior case 30 that passes through the center of the exterior case 30 in a plan view and extends frontward and rearward.

The dial ring 40 has a flat-plate portion the outer circumferential end of which is in contact with the inner circumferential surface of the bezel 32 and has one surface parallel to the cover glass plate 33 and an inclined portion that is so inclined toward the dial 11 that the inner circumferential end of the inclined portion is in contact with the dial 11. The dial ring 40 has a ring-like shape in the plan view and has a bowl-like shape in a cross sectional view. The flat-plate portion and the inclined portion of the dial ring 40 and the inner circumferential surface of the bezel 32 form a donut-shaped accommodation space that accommodates a ring-shaped antennal body 110.

The antenna body 110 is formed of a ring-shaped dielectric base on which a metal antenna pattern is formed, for example, in a plating process or a silver paste printing process. The antenna body 110 is disposed along the outer circumference of the dial 11 but inside the inner circumferential surface of the bezel 32 and covered with the dial ring 40 made of a plastic material and the cover glass plate 33, whereby satisfactory signal reception is ensured. The dielectric base can be molded by using a dielectric material usable with high frequencies, such as a titanium oxide, combined with a resin, whereby, in conjunction with wavelength shortening achieved by the dielectric base, the size of the antenna can be further reduced.

The dial 11 is a circular plate on which time is displayed inside the exterior case 30. The dial 11 is made of a light transmissive material, such as a plastic material, provided with the indication hands 21, 22, and 23 and other components between the dial 11 and the cover glass plate 33, and disposed inside the dial ring 40.

A solar panel 135, which photo-electrically generates electric power, is provided between the dial 11 and a main plate 125, to which the drive mechanism 140 is attached. The solar panel 135 is a circular flat plate in which a plurality of solar cells (photo-electric, power generating devices), each of which converts optical energy into electric energy (electric power), are serially connected to each other. The solar panel 135 also has a sunlight detection function. Each of the dial 11, the solar panel 135, and the main plate 125 has holes through which the indication hand shaft 25 and indication hand shafts (not shown) associated with the indication hand 71 in the first small window 70, the indication hand 81 in the second small window 80, and the indication hand 91 in the third small window 90 pass and also has an opening of the calendar small window 15.

The drive mechanism 140 is attached to the main plate 125, and the rear side of the drive mechanism 140 is covered with a circuit substrate 120. The drive mechanism 140 has a stepper motor and wheel trains, such as gears. The stepper motor rotates the indication hand shaft 25 and other components via the wheel trains to drive the indication hands that form a display device 141.

The drive mechanism 140 specifically includes first to sixth drive mechanisms. The first drive mechanism drives the indication hand (minute hand) 22 and the indication hand (hour hand) 23, which represent "minute" and "hour" of an internal timepiece (current time). Each of the indication hand 21, the indication hand 71 in the first small window 70, the indication hand 81 in the second small window 80, and the indication hand 91 in the third small window 90 shown in FIG. 2 is driven by a similar drive mechanism (not shown). That is, the second drive mechanism drives the indication hand (chronograph second hand) 21, which represents "second" in the chronograph function. The third drive mechanism drives the indication hand (chronograph minute hand) 71, which represents "minute" in the chronograph function. The fourth drive mechanism drives the indication hand (small second hand) 81, which represents "second" of the internal timepiece. The fifth drive mechanism drives the indication hand (chronograph hour hand) 91, which represents "hour" in the chronograph function. The sixth drive mechanism drives the calendar wheel 16, which is visible through the calendar small window 15.

The circuit substrate 120 includes a reception device (GPS module) 121, a control device 300, and a storage device 200. The circuit substrate 120 and the antenna body 110 are connected to each other via an antenna connection pin 115. A circuit presser 122, which covers the reception device 121, the control device 300, and the storage device 200, which are mounted on the circuit substrate 120, is provided on the side of the circuit substrate 120 that faces the case back 34 (rear side). A secondary battery 130, such as a lithium ion battery, is provided between the main plate 125 and the case back 34. The secondary battery 130 is charged with the electric power generated by the solar panel 135.

The antenna body 110 is fed via a feed point to which the antenna connection pin 115 located on the rear side of the antenna body 110 is connected. The antenna connection pin 115 is a pin-shaped connector made of a metal, protrudes from the circuit substrate 120, and passes through an insertion hole open through the main plate 125 and is then inserted into the accommodation space. The circuit substrate 120 is thus connected to the antenna body 110 in the accommodation space via the antenna connection pin 115.

Display Mechanism of Electronic Timepiece

The outermost circumference of the dial 11 is inscribed with markings that divide the outer circumference into 60 portions, and each of the 60 portions is further inscribed with ⅕ markings that divide the portion into 5 portions, as shown in FIG. 2. Using the markings, the indication hand 21 displays the "second" in the chronograph function, the indication hand 22 displays the "minute" of the internal timepiece, and the indication hand 23 displays the "hour" of the internal timepiece. The chronograph function can be used by operating the C button 63 and the D button 64.

The outer circumference of the circular first small window 70, which is provided in the dial 11, is inscribed with markings that divide the outer circumference into 60 portions and are expressed in the form of numerals incremented by 10 from "10" to "60". The indication hand 71 uses the markings to display the "minute" in the chronograph function.

The outer circumference of the circular second small window 80, which is provided in the dial 11, is inscribed with markings that divide the outer circumference into 60 portions and are expressed in the form of numerals from "0" to "11". The indication hand 81 uses the markings to display the "second" of the internal timepiece.

An alphabetical English letter "Y" is inscribed in the 52-second position of the second small window 80, and an alphabetical English letter "N" is inscribed in the 38-second position of the second small window 80. The English letters represent results of acquisition of a variety of pieces of information (Y: reception (acquisition) successful, N; reception (acquisition) failed) based on a satellite signal received from a satellite. When a user operates the B button 62 to enter a reception result display mode, the indication hand 81 points "Y" or "N" to show a result of acquisition of the satellite signal. Further, the user can operate the A button 61 and the B button 62 to switch satellite signal automatic reception between ON and OFF.

A description will be made of the outer circumference of the circular third small window 90 provided in the dial 11. In the following description of ranges of the outer circumference, "n-o'clock direction" (n is arbitrary natural number) means a direction along which the circular outer circumference of the third small window 90 is viewed from the center thereof.

The range of the outer circumference of the third small window 90 from 12-o'clock direction to the 6-o'clock direction is inscribed with markings that divide the range into 6 portions and are expressed in the form of numerals from "0" to "5". The indication hand 91 uses the markings to display the "hour" in the chronograph function. In the chronograph function, the indication hands 21, 71, and 91 can be used to measure time up to 5 hours 59 minutes 59 seconds.

The outer circumference of the third small window 90 in the range from 6-o'clock direction to the 7-o'clock direction is inscribed with English letters "DST" and a symbol "o". DST stands for daylight saving time. These English letters and symbol represent daylight saving time setting (DST: daylight saving time ON, o: daylight saving time OFF). The user can switch the daylight saving time setting in the electronic timepiece 10 between ON and OFF by operating the crown 50 and the B button 62 to position the indication hand 91 at "DST" or "o".

The outer circumference of the third small window 90 in the range from 7-o'clock direction to the 9-o'clock direction is inscribed with a crescent, sickle-shaped symbol 92 having a thick 9-o'clock-direction base portion and a thin 7-o'clock-direction front end portion. The symbol 92 is a power indicator indicating the power of the secondary battery 130 (see FIG. 3), and the indication hand 91 points the base portion, the front end portion, or an intermediate portion of the symbol 92 in accordance with the amount of power left in the battery.

The outer circumference of the third small window 90 in the range from 9-o'clock direction to the 10-o'clock direction is inscribed with an airplane-shaped symbol 93. The symbol represents an in-airplane mode. The aviation law prohibits reception of a satellite signal during takeoff or landing of an airplane. When the user operates the A button 61 to select the symbol 93 (in-airplane mode) by moving the indication hand 91, satellite signal reception in the electronic timepiece 10 can be disabled.

The outer circumference of the third small window 90 in the range from 10-o'clock direction to the 12-o'clock direction is inscribed with a numeral "1" and a symbol "4+". The numeral and the symbol represent a satellite signal reception mode. The numeral "1" means that GPS time information is received and the internal time is corrected (timing mode), and the symbol "4+" means that GPS time information and orbit information are received and the internal time and a time zone that will be described later are corrected (positioning mode).

Further, the user can operate the A button 61 to set the reception mode. That is, when the user selects "1" by moving the indication hand 91, a time information reception mode (timing mode) is set. When the user select "4+" by moving the indication hand 91, a position information reception mode (positioning mode) is set.

Further, when the user operates the B button 62 to select an information acquisition result mode, the indication hand 91 points "1" or "4+" to display the satellite signal reception mode according to which the electronic timepiece 10 received a satellite signal last time.

The calendar small window 15 is provided in a rectangular opening open in the dial 11, and a numeral printed on the calendar wheel 16 is visible through the opening. The numeral represents the "day" of year/month/day.

A description will now be made of the relationship among coordinated universal time (UTC), a time difference, the standard time, and a time zone.

The time zone is a region where common standard time is used, and 40 time zones are currently present. The time zones are distinguished from each other based on the time difference between the standard time in each of the time zones and UTC. For example, Japan belongs to a +9-hour time zone where standard time that is 9 hours ahead of UTC is used. The standard time used in each of the time zones can be determined based on UTC and the time difference from UTC.

As described above, the dial 11 has the inscribed markings that divide the dial 11 into 60 portions representing minute and second, and the dial ring 40, which surrounds the outer circumference of the dial 11, has time difference information 45 inscribed along the markings. The time difference information 45 represents the time difference from the coordinated universal time (UTC) and is formed of numerals and non-numeral symbols. Each of the numerals in the time difference information 45 is an integer time difference, and each of the symbols in the time difference information 45 is a non-integer time difference. The user can check the time difference between the internal time displayed with the indication hands 22, 23, and 81 and UTC by looking at the time difference information 45 pointed by the indication hand 21 in response to operation of the crown 50.

The bezel 32, which is provided around the dial ring 40, has city information 35 inscribed along with the time difference information 45. The city information 35 represents the names of representative cities in the time zones where standard time values corresponding to time differences in the time difference information 45 inscribed on the dial ring 40 are used. The inscribed time difference information 45 and city information 35 are called time zone displaying characters 46. In the present embodiment, the number of time zone displaying characters 46 is equal to the number of time zones used worldwide.

Electrical Mechanism of Electronic Timepiece

Figure 4:
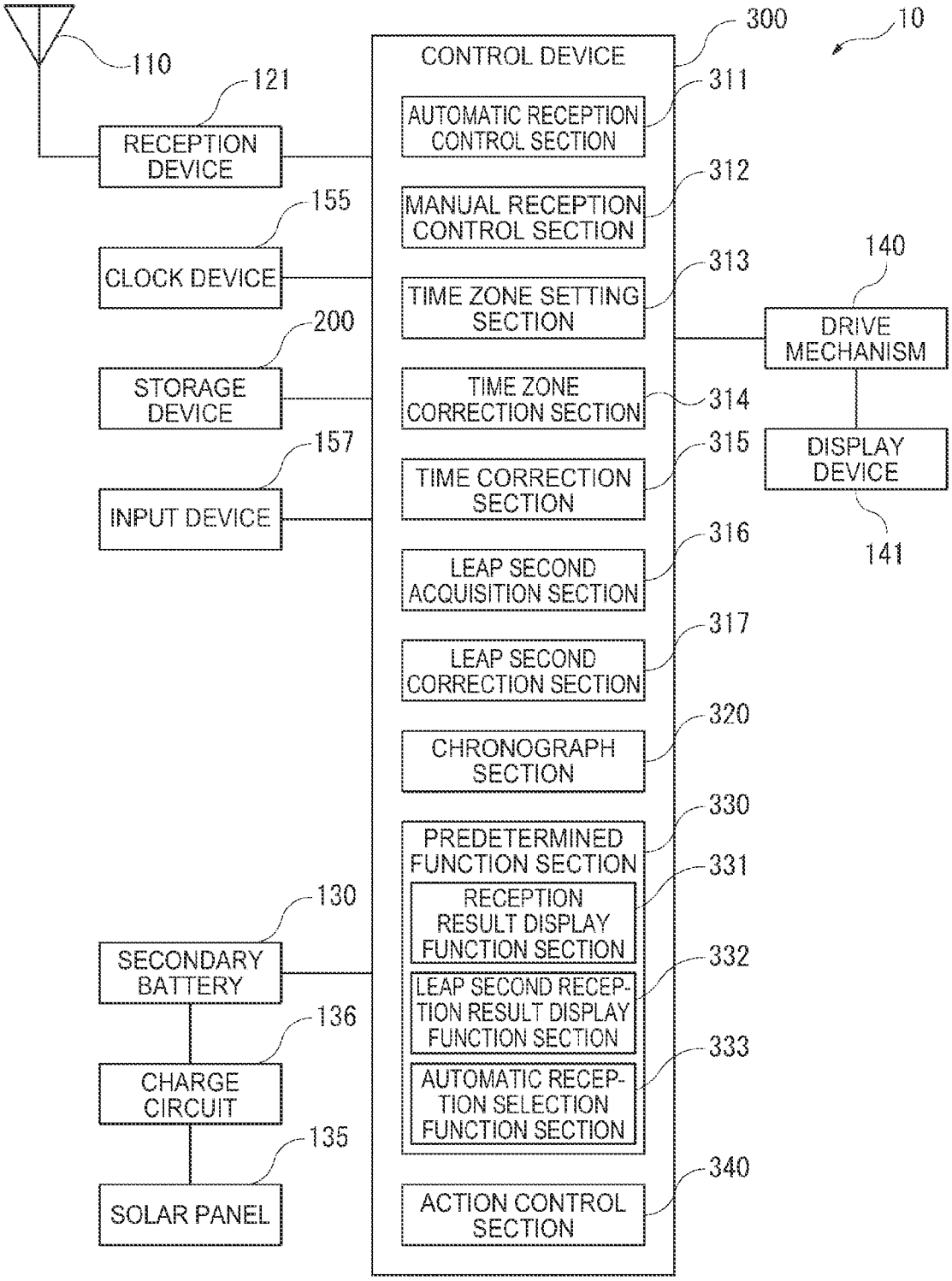
FIG. 4 is an electrical control block diagram of the electronic timepiece.

FIG. 4 is an electrical control block diagram of the electronic timepiece 10.

The electronic timepiece 10 includes the control device 300 formed of a CPU (central processing unit), the storage device 200 formed of a RAM (random access memory) and a ROM (read only memory), and peripheral devices formed of the reception device (GPS module) 121, an input device 157, the drive mechanism 140, and a clock device 155, as shown in FIG. 4. The devices described above transmit and receive data via a data bus. The input device 157 is formed of the crown 50, the A button 61, the B button 62, the C button 63, and the D button 64 shown in FIG. 2. The electronic timepiece 10 has the built-in secondary battery 130 (see FIG. 3), which serves as a power supply and is rechargeable. The secondary battery 130 is charged with the electric power supplied from the solar panel 135.

Reception Device

The reception device 121 is connected to the antenna body 110 and processes a satellite signal received via the antenna body 110 to acquire the GPS time information and the position information. The antenna body 110 receives electrical radiation that carries satellite signals having been transmitted from the plurality of GPS satellites 8 (see FIG. 1), which go around the earth along a predetermined orbit up in the sky, and having passed through the cover glass plate 33 and the dial ring 40 shown in FIG. 3.

The reception device 121 includes, although not shown, an RF (radio frequency) section that receives a satellite signal transmitted from any of the GPS satellites 8 (see FIG. 1) and converts the satellite signal into a digital signal, a BB (baseband) section that performs correlation evaluation on the received signal to demodulate the navigation message, and an information acquisition section that acquires and outputs the GPS time information and the position information (positioning information) from the navigation message (satellite signal) demodulated by the BB section, as a typical GPS device does.

The RF section includes a bandpass filter, a PLL circuit, an IF filter, a VCO (voltage controlled oscillator), an ADC (A/D converter), a mixer, an LNA (low noise amplifier), an IF amplifier, and other components. The satellite signal extracted through the bandpass filter is amplified by the LNA, and is mixed by the mixer with a signal from the VCO into a down-converted IF (intermediate frequency) signal. The IF signal having undergone the mixing in the mixer passes through the IF amplifier and the IF filter and is converted into a digital signal by the ADC.

The BB section includes a local code generator that generates a local code formed of the same C/A code used at the time of transmission from each of the GPS satellites 8 and a correlator that calculates a correlation value between the local code and the received signal outputted from the RF section. When the correlation value calculated by the correlator is greater than or equal to a predetermined threshold, the C/A code used in the received satellite signal coincides with the generated local code, whereby the satellite signal can be captured (synchronized). The navigation message can therefore be demodulated by processing the received satellite signal in a correlation process using the local code.

The information acquisition section acquires the GPS time information and the position information from the navigation message demodulated by the BB section. The navigation message contains subframe data, such as preamble data and TOW (time of week, also referred to as "Z count") in a HOW word. The subframe data is formed of subframe 1 to subframe 5, each of which contains, for example, satellite correction data including week number data and a satellite health state, ephemeris (detailed orbit information for each GPS satellite 8), and almanac (schematic orbit information for overall GPS satellites 8). The information acquisition section can therefore extract predetermined data portions from the received navigation message to acquire the GPS time information and the position information.

Each of the subframes 4 and 5 contains orbit information (almanac) for the overall satellites and ionosphere correction information, and the information described above is formed of a large amount of data and hence divided into pages before incorporated in the subframe. That is, the data transmitted by using each of the subframes 4 and 5 is divided into pages 1 to 25, and the information in the different pages is sequentially transmitted on a frame basis. Since transmitting information in the entire pages requires 25 frames, receiving the entire information in a navigation message requires 12 minutes and 30 seconds. Leap second information (leap second update information) is stored in the page 18 in the subframe 4. The leap second information can therefore be acquired through reception of the page 18 in the subframe 4.

Clock Device

The clock device 155 includes a quartz oscillator or any other component driven by electric power accumulated in the secondary battery 130 and updates time data by using a reference signal based on an oscillation signal from the quartz oscillator.

Storage Device

Figure 5:
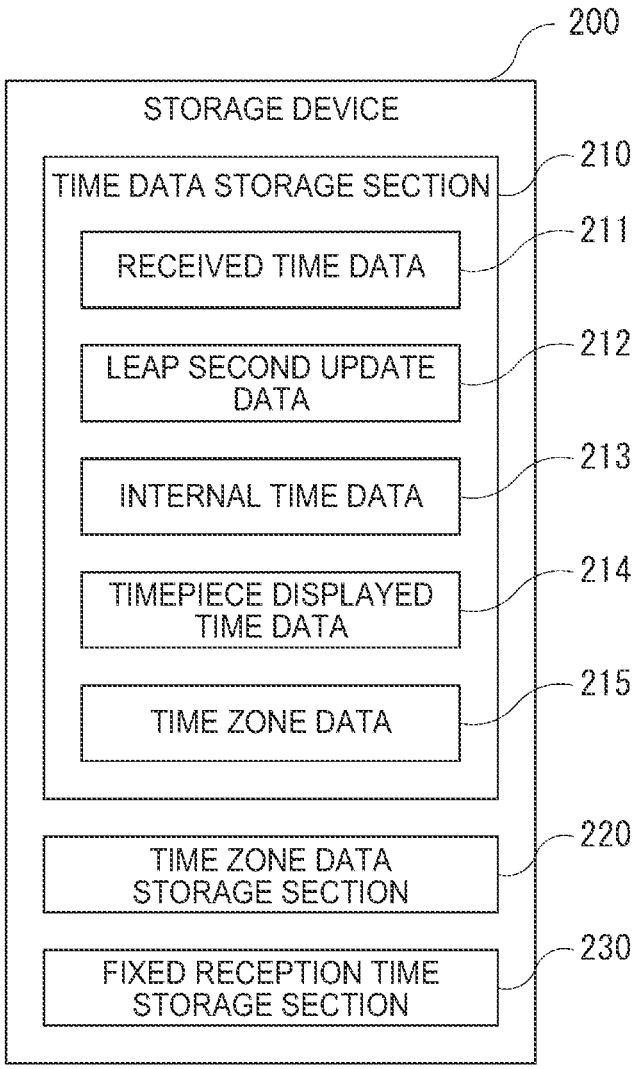
FIG. 5 is a data structure diagram of a storage device according to the embodiment.

The storage device 200 includes a time data storage section 210, a time zone data storage section 220, and a fixed received time storage section 230, as shown in FIG. 5.

The time data storage section 210 stores received time data 211, leap second update data 212, internal time data 213, timepiece displayed time data 214, and time zone data 215.

The received time data 211 stores the time information acquired from a satellite signal (GPS time). The received time data 211 is typically updated by the clock device 155 every second, and when a satellite signal is received, the time information stored in the received time data 211 is corrected by using the acquired time information (GPS time).

The leap second update data 212 stores at least current leap second data. That is, the page 18 in the subframe 4 of a satellite signal contains "current leap second," "leap second update week," "leap second update day," and "leap second after the update," which are data on the leap second. Among the data described above, in the present embodiment, the leap second update data 212 stores at least the "current leap second" data.

The internal time data 213 stores internal time information. The internal time information is updated by the GPS time stored in the received time data 211 and the "current leap second" stored in the leap second update data 212. That is, the internal time data 213 stores UTC (coordinated universal time). When the received time data 211 is updated by the clock device 155 described above, the internal time information is also updated.

The timepiece displayed time data 214 stores the internal time information in the internal time data 213 described above but processed based on time zone data (time difference information) in the time zone data 215. The time zone data 215 is set based on position information manually selected by the user or received in the positioning mode.

The time zone data storage section 220 stores position information (latitude and longitude) and a time zone (time difference information) related to each other. Therefore, when position information is acquired in the positioning mode, the control device 300 can acquire time zone data based on the position information (latitude and longitude).

The time zone data storage section 220 further stores a city name and time zone data related to each other. Therefore, when the user operates the input device 157, such as the crown 50, to select the name of a city where the user desires to know the local time as described above, the control device 300 searches the time zone data storage section 220 for the city name set by the user, acquires time zone data corresponding to the city name, and sets the time zone data in the time zone data 215.

The fixed reception time storage section 230 stores fixed reception time at which a fixed-time reception process, which will be described later, is carried out. The fixed reception time stored in the fixed reception time storage section 230 is the last time when the B button 62 is operated with successful forced reception.

The storage device 200 does not store information on the orbit (almanac, ephemeris) of any of the position information satellites. In the electronic timepiece 10, which is a wristwatch, the capacity of the storage device 200 is therefore limited, and the capacity of the secondary battery 130 is also limited. The two reasons described above make it difficult to perform long-period reception for acquisition of the orbit information. A reception process carried out by the electronic timepiece 10 is therefore carried out in a cold start state in which no orbit information is present.

Control Device

The control device 300 is formed of a CPU that controls the electronic timepiece 10. The control device 300 includes an automatic reception control section (which forms reception control section according to the invention) 311, a manual reception control section 312, a time zone setting section 313, a time zone correction section 314, a time correction section 315, a leap second acquisition section 316, a leap second correction section 317, a chronograph section 320, a predetermined function section 330, and an action control section 340.

Automatic Reception Control Section

The automatic reception control section 311 activates the reception device 121 when a satellite signal automatic reception condition is satisfied to cause the reception device 121 to carry out an automatic reception process in the timing mode.

The automatic reception process includes two types of automatic reception process, a fixed-time automatic reception process and an optical automatic reception process.

When automatic reception timing set at predetermined intervals is reached, the automatic reception control section 311 activates the reception device 121 to cause it to carry out the fixed-time automatic reception process in the timing mode. For example, when the timepiece displayed time data 214 that is being clocked reaches the fixed reception time stored in the fixed reception time storage section 230 every third day, the automatic reception control section 311 activates the reception device 121 to cause it to carry out the fixed-time automatic reception process in the timing mode.

On the other hand, when it is determined that the voltage or current of the electric power generated by the solar panel 135 reaches a preset value or becomes greater than the preset value, and that the solar panel 135 is irradiated with sunlight in an outdoor environment, the automatic reception control section 311 activates the reception device 121 to cause it to carry out the optical automatic reception process in the timing mode. The number of processes of activating the reception device 121 in accordance with the state of power generation of the solar panel 135 may be limited to, for example, once a day.

In the automatic reception process, the reception device 121 captures at least one of the GPS satellites 8 and receives a satellite signal transmitted from the captured GPS satellite 8 to acquire the time information.

When a satellite signal has been successfully received and the time information has been acquired, or when no satellite signal has been successfully received but a preset reception period has elapsed (when reception has failed), the automatic reception control section 311 carries out a reception result display process to cause the display device 141 to display a result of the satellite signal reception.

That is, the automatic reception control section 311 moves the indication hand 91 to the position showing the numeral "1", which represents the timing mode. In the case where the reception has been successful, the automatic reception control section 311 moves the indication hand 81 to the position showing "Y", whereas when the reception has failed, the automatic reception control section 311 moves the indication hand 81 to the position showing "N".

Manual Reception Control Section

The manual reception control section 312 activates the reception device 121 based on input operation performed on the input device 157 to cause the reception device 121 to carry out a manual reception process in the timing mode or the positioning mode.

Specifically, when the user keeps pressing the B button 62 of the input device 157 for a period longer than or equal to 3 seconds but shorter than 6 seconds for forced reception, the manual reception control section 312 activates the reception device 121 to cause it to carry out the manual reception process in the timing mode.

In the manual reception process in the timing mode, the reception device 121 captures at least one of the GPS satellites 8 and receives a satellite signal transmitted from the captured GPS satellite 8 to acquire the time information.

On the other hand, when the user keeps pressing the B button 62 for a period longer than or equal to 6 seconds for forced reception, the manual reception control section 312 activates the reception device 121 to cause it to carry out the manual reception process in the positioning mode.

In the manual reception process in the positioning mode, the reception device 121 captures at least three of the GPS satellites 8, preferably, four or more thereof, receives satellite signals transmitted from the captured GPS satellites 8, and calculates and acquires the position information. The reception device 121 can also acquire the time information at the same time when it receives the satellite signals.

When satellite signals have been successfully received and the time information or the position information has been acquired, or when no satellite signal has been successfully received but the preset reception period has elapsed (when reception has failed), the manual reception control section 312 carries out the reception result display process to cause the display device 141 to display a result of the satellite signal reception.

That is, when the reception process is carried out in the timing mode, the manual reception control section 312 moves the indication hand 91 to the position showing the numeral "1", whereas in the positioning mode, the manual reception control section 312 moves the indication hand 91 to the position showing the symbol "4+". When the reception has been successful, the manual reception control section 312 moves the indication hand 81 to the position showing "Y", whereas when the reception has failed, the manual reception control section 312 moves the indication hand 81 to the position showing "N".

Time Zone Setting Section

When the position information has been successfully acquired in the reception process in the positioning mode performed by the manual reception control section 312, the time zone setting section 313 sets time zone data based on the acquired position information (latitude and longitude). Specifically, the time zone setting section 313 selects and acquires time zone data (time zone information, that is, time difference information) corresponding to the position information from the time zone data storage section 220 and stores the time zone data in the time zone data 215.

The Japan standard time (JST) is 9 hours ahead of UTC (UTC+9). For example, when the acquired position information indicates Japan, the time zone setting section 313 reads time difference information associated with the Japan standard time (+9 hours) from the time zone data storage section 220 and stores the time difference information in the time zone data 215.

Time Zone Correction Section

After the time zone setting section 313 sets time zone data, the time zone correction section 314 uses the time zone data to correct the timepiece displayed time data 214. The timepiece displayed time data 214 is therefore the sum of the internal time data 213, which is UTC, and the time zone data.

Time Correction Section

When the time information has been successfully acquired in the reception process carried out by the automatic reception control section 311 or the manual reception control section 312, the time correction section 315 corrects the received time data 211 by using the acquired time information. The internal time data 213 and the timepiece displayed time data 214 are therefore also corrected.

Leap Second Acquisition Section

In a case where a leap second reception condition is satisfied and the automatic reception control section 311 or the manual reception control section 312 carries out the reception process, the leap second acquisition section 316 carries out a leap second acquisition process. In the leap second acquisition process, the reception device 121 acquires leap second information subsequently to the acquisition of the time information.

The case where a leap second reception condition is satisfied is either a case where the leap second update data 212 stores no leap second information or a case where the month/day derived from the internal time information stored in the internal time data 213 falls within a leap second reception period and no leap second information reception has been successful within the period.

In the leap second acquisition process, the reception device 121 captures at least one of the GPS satellites 8, receives a satellite signal transmitted from the captured GPS satellite 8, and acquires leap second information. It is noted that the leap second information is stored in the page 18 in the subframe 4 as described above and transmitted at the intervals of 12.5 minutes.

Leap Second Correction Section

The leap second correction section 317 uses the leap second information acquired in the leap second acquisition process carried out by the leap second acquisition section 316 to correct the leap second information stored in the leap second update data 212.

Chronograph Section

The chronograph section 320 is activated when the C button 63 is pressed in a typical time display mode and starts chronograph action (time measurement). That is, the operation of pressing the C button 63 corresponds to the time measurement input operation in an embodiment of the invention. Further, when the C button 63 is pressed again, the chronograph action is terminated. When the D button 64 is pressed in the terminated state, the chronograph action is reset and the action of the chronograph section 320 is terminated. The control then returns to the time display mode. That is, the chronograph section 320 forms the time measurement section that measures time in an embodiment of the invention.

Predetermined Function Section

The predetermined function section 330 includes a reception result display function section 331, which displays a result of satellite signal reception, a leap second reception result display function section 332, which displays a result of leap second information reception, and an automatic reception selection function section 333, which selects whether the function of the automatic reception control section 311 is enabled or disabled, and each of the function sections is activated based on input operation performed on the input device 157.

The reception result display function section 331 is activated when the user keeps pressing the B button 62 for a period shorter than 3 seconds in the typical time display mode and causes the display device 141 to display a result of the reception in the last satellite signal reception process.

That is, when the reception process is carried out in the timing mode, the reception result display function section 331 moves the indication hand 91 to the position showing the numeral "1", whereas in the positioning mode, the reception result display function section 331 moves the indication hand 91 to the position showing the symbol "4+". When the reception has been successful, the reception result display function section 331 moves the indication hand 81 to the position showing "Y", whereas when the reception has failed, the reception result display function section 331 moves the indication hand 81 to the position showing "N".

The leap second reception result display function section 332 is activated when the user keeps pressing the B button 62 for a period shorter than 3 seconds and then presses the B button 62 once again in the typical time display mode and causes the display device 141 to display a result of the reception in the last leap second information reception process.

That is, the leap second reception result display function section 332 moves the indication hand 91 to the position showing the numeral "0" inscribed in the 12-o'clock direction. When the reception has been successful, the leap second reception result display function section 332 moves the indication hand 81 to the position showing "Y", whereas when the reception has failed, the leap second reception result display function section 332 moves the indication hand 81 to the position showing "N".

The automatic reception selection function section 333 is activated when the user keeps pressing the A button 61 and the B button 62 at the same time for a period longer than or equal to 3 seconds in the typical time display mode and switches the function of the automatic reception control section 311 between the enabled state and the disabled state whenever the B button 62 is pressed.

At this point, the automatic reception selection function section 333 moves the indication hand 81 to the position indicating the enabled or disabled state. For example, in the enabled state, the automatic reception selection function section 333 moves the indication hand 81 to the position indicating the 10-second position, whereas in the disabled state, the automatic reception selection function section 333 moves the indication hand 81 to the position indicating the 20-second position.

Each of the action of the function sections 331 to 333 is terminated when any of the A button 61 to D button 64 and the crown 50 is operated.

Action Control Section

The action control section 340 detects input operation performed on the input device 157 and controls initiation and termination of the action of each of the automatic reception control section 311, the manual reception control section 312, the chronograph section 320, and the predetermined function section 330.

Further, the action control section 340, when it terminates the fixed-time automatic reception process carried out by the automatic reception control section 311, sets the following automatic reception timing in such a way that the automatic reception is performed after a period shorter than the predetermined interval described above. For example, the action control section 340 sets the following automatic reception timing to be the fixed reception time on the following day.

Control Process

A control process carried out by the electronic timepiece 10 will next be described with reference to the flowcharts shown in FIGS. 6 to 10.

Figure 6:
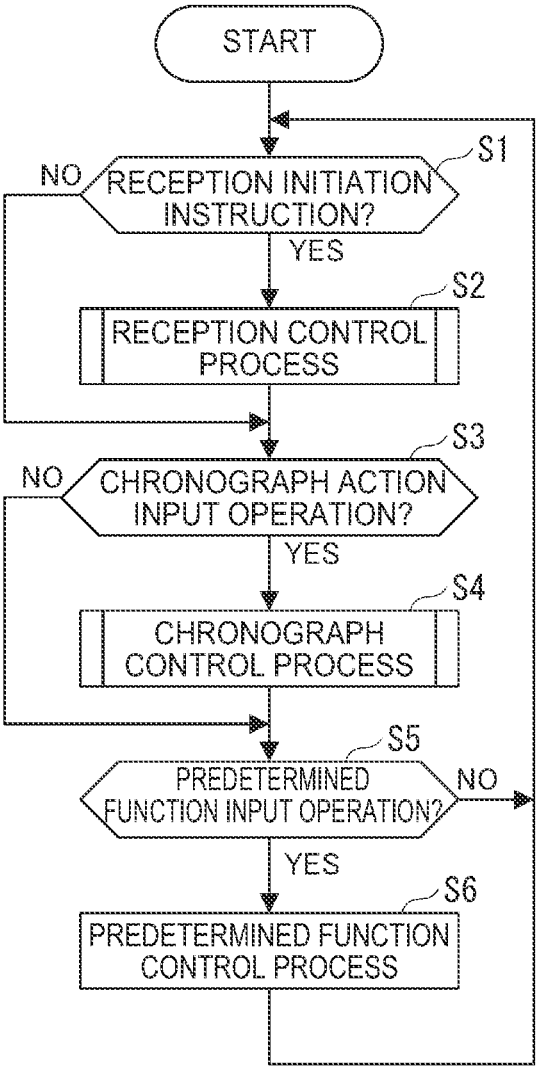
FIG. 6 is a flowchart showing a control process carried out by the electronic timepiece.

As shown in FIG. 6, the control device 300 evaluates whether the automatic reception condition that activates the automatic reception control section 311 is satisfied or input operation that activates the manual reception control section 312 has been performed (B button 62 has been pressed for at least 3 seconds). That is, the control device 300 evaluates whether an instruction of initiating the satellite signal reception process has been issued (S1).

When the evaluation result in S1 is YES, the control device 300 carries out a reception control process S2, which will be described later.

When the evaluation result in S1 is NO or after the process S2, the control device 300 evaluates whether input operation that initiates the chronograph action has been performed (whether C button 63 has been pressed) (S3).

When the evaluation result in S3 is YES, the control device 300 carries out a chronograph control process S4, which will be described later.

When the evaluation result in S3 is NO or after the process S4, the control device 300 evaluates whether any of the input operations described above that activate the predetermined function section 330 has been performed (S5).

When the evaluation result in S5 is YES, the control device 300 carries out a predetermined function control process S6, which will be described later.

When the evaluation result in S5 is NO or after the process S6, the control device 300 returns the control to the process in S1. The processes in S1 to S6 are thus repeatedly carried out.

Reception Control Process

The reception control process S2 will next be described.

Figure 7:
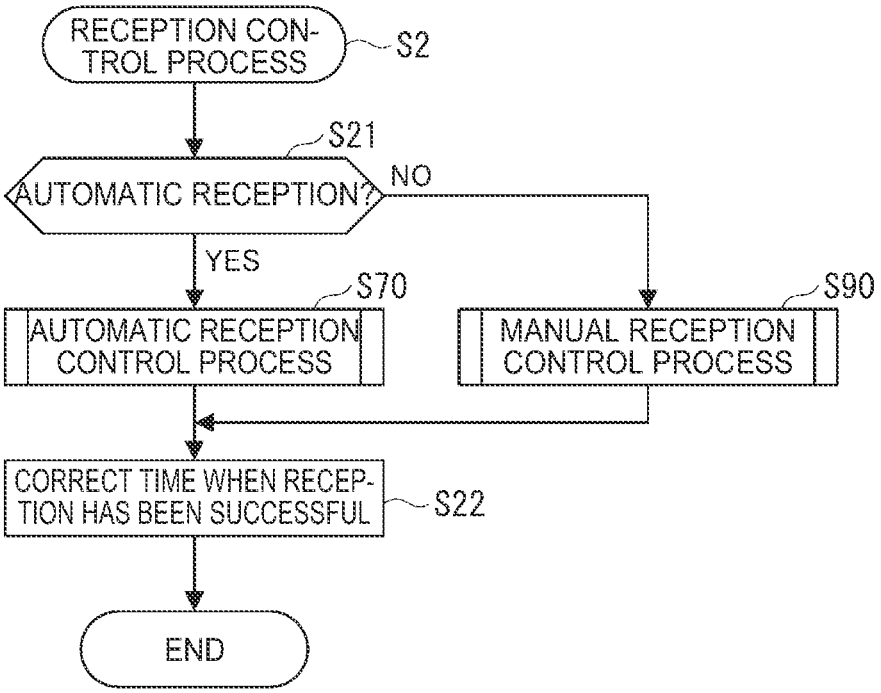
FIG. 7 is a flowchart showing a reception control process in the control process.

The control device 300 first evaluates whether the reception process evaluated in S1 is the automatic reception process (S21), as shown in FIG. 7.

When the evaluation result in S21 is YES, the control device 300 carries out an automatic reception control process S70.

Automatic Reception Control Process

Figure 8:
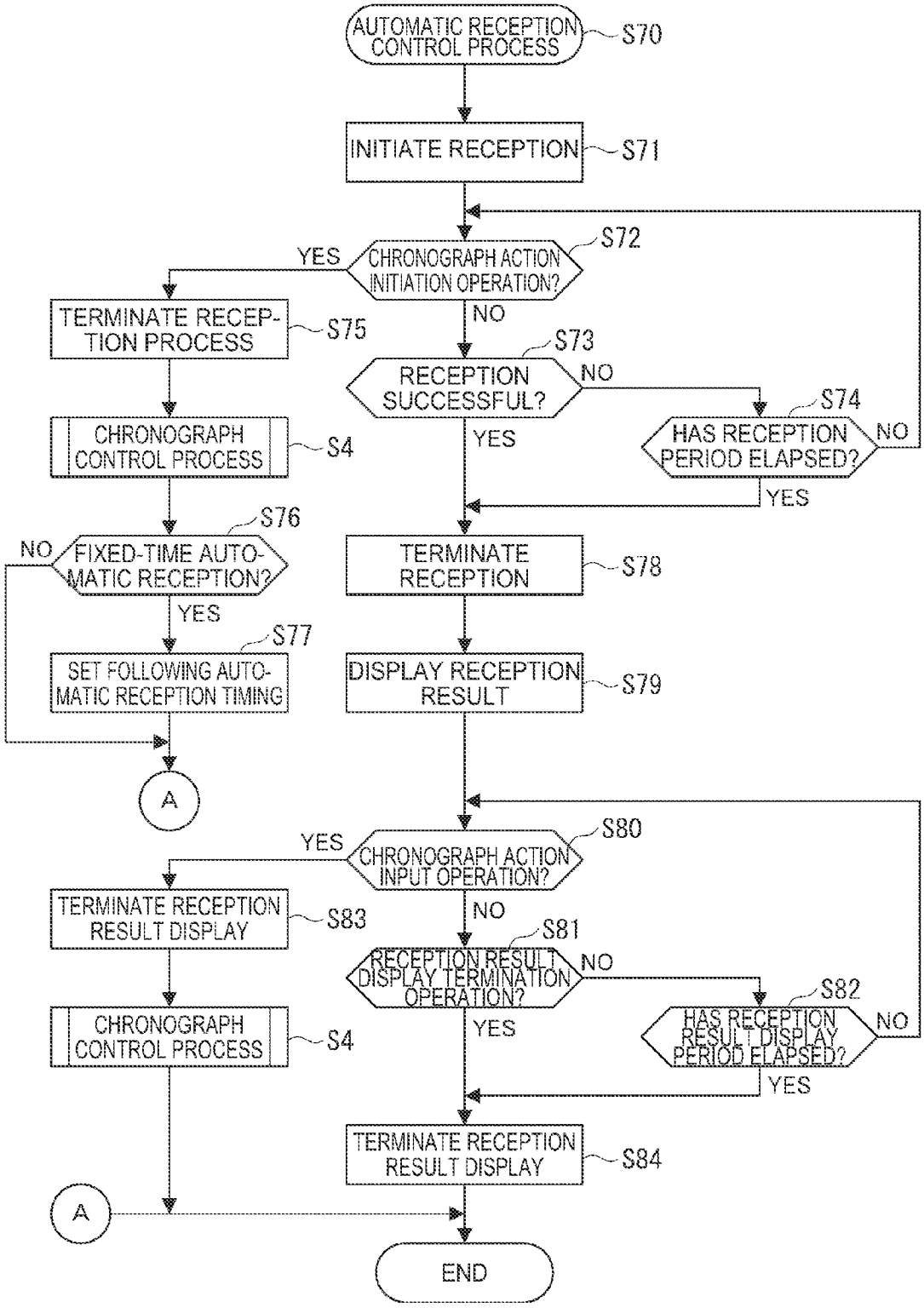
FIG. 8 is a flowchart showing an automatic reception control process in the control process.

The automatic reception control section 311 first activates the reception device 121 to cause it to initiate the satellite signal reception process (S71), as shown in FIG. 8. That is, S71 is the reception control step in an embodiment of the invention.

The action control section 340 then evaluates whether input operation that initiates the chronograph action has been performed (S72).

When the evaluation result in S72 is NO, the automatic reception control section 311 evaluates whether a satellite signal has been successfully received in the reception process and the time information has been acquired (S73).

When the evaluation result in S73 is NO, the automatic reception control section 311 evaluates whether a preset reception period has elapsed since the initiation of the reception process (S74).

When the evaluation result in S74 is NO, the automatic reception control section 311 returns the control to the process in S72. That is, except a case where the evaluation result in S72 is YES and a case where the evaluation result in S73 is YES, the evaluation processes in S72, S73, and S74 are repeatedly carried out until the reception period described above elapses.

When the evaluation result in S72 is YES, the action control section 340 terminates the action of the automatic reception control section 311 (S75). That is, the action control section 340 forcibly terminates the reception process.

The action control section 340 then causes the control device 300 to carry out the chronograph control process S4, which will be described later. That is, S72 and S75 form the action control step in an embodiment of the invention.

After the chronograph control process S4 is carried out and terminated, the action control section 340 evaluates whether the reception process is the fixed-time automatic reception process (S76). When the evaluation result in S76 is NO, the control device 300 terminates the automatic reception control process S70.

When the evaluation result in S76 is YES, the action control section 340 sets the following automatic reception timing in such a way that the automatic reception is performed after a period shorter than the predetermined interval described above. For example, the action control section 340 sets the following automatic reception timing to be the fixed reception time on the following day (S77). At this point, the action control section 340 sets again the reception timing at the predetermined intervals with reference to the thus set following reception timing. The control device 300 then terminates the automatic reception control process S70.

When the evaluation result in S73 is YES or when the evaluation result in S74 is YES, the automatic reception control section 311 terminates the satellite signal reception process (S78).

The automatic reception control section 311 then carries out the reception result display process to cause the display device 141 to display a result of the satellite signal reception (S79).

The action control section 340 then evaluates whether input operation that initiates the chronograph action has been performed (S80).

When the evaluation result in S80 is NO, the automatic reception control section 311 evaluates whether input operation that terminates the reception result display process has been performed (whether B button 62 has been pressed) (S81).

When the evaluation result in S81 is NO, the automatic reception control section 311 evaluates whether a preset display period has elapsed since the initiation of the reception result display process (S82).

When the evaluation result in S82 is NO, the automatic reception control section 311 returns the control to the process in S80. That is, except a case where the evaluation result in S80 is YES and a case where the evaluation result in S81 is YES, the evaluation processes in S80, S81, and S82 are repeatedly carried out until the display period described above elapses.

When the evaluation result in S80 is YES, the action control section 340 terminates the action of the automatic reception control section 311 (S83). That is, the action control section 340 forcibly terminates the reception result display process.

The action control section 340 then carries out the chronograph control process S4, which will be described later. The control device 300 then terminates the automatic reception control process S70.

When the evaluation result in S81 is YES or when the evaluation result in S82 is YES, the automatic reception control section 311 stops displaying the reception result (S84). The control device 300 then terminates the automatic reception control process S70.

Referring back to FIG. 7, when the evaluation result in S21 is NO, the control device 300 carries out a manual reception control process S90.

Manual Reception Control Process

Figure 9:
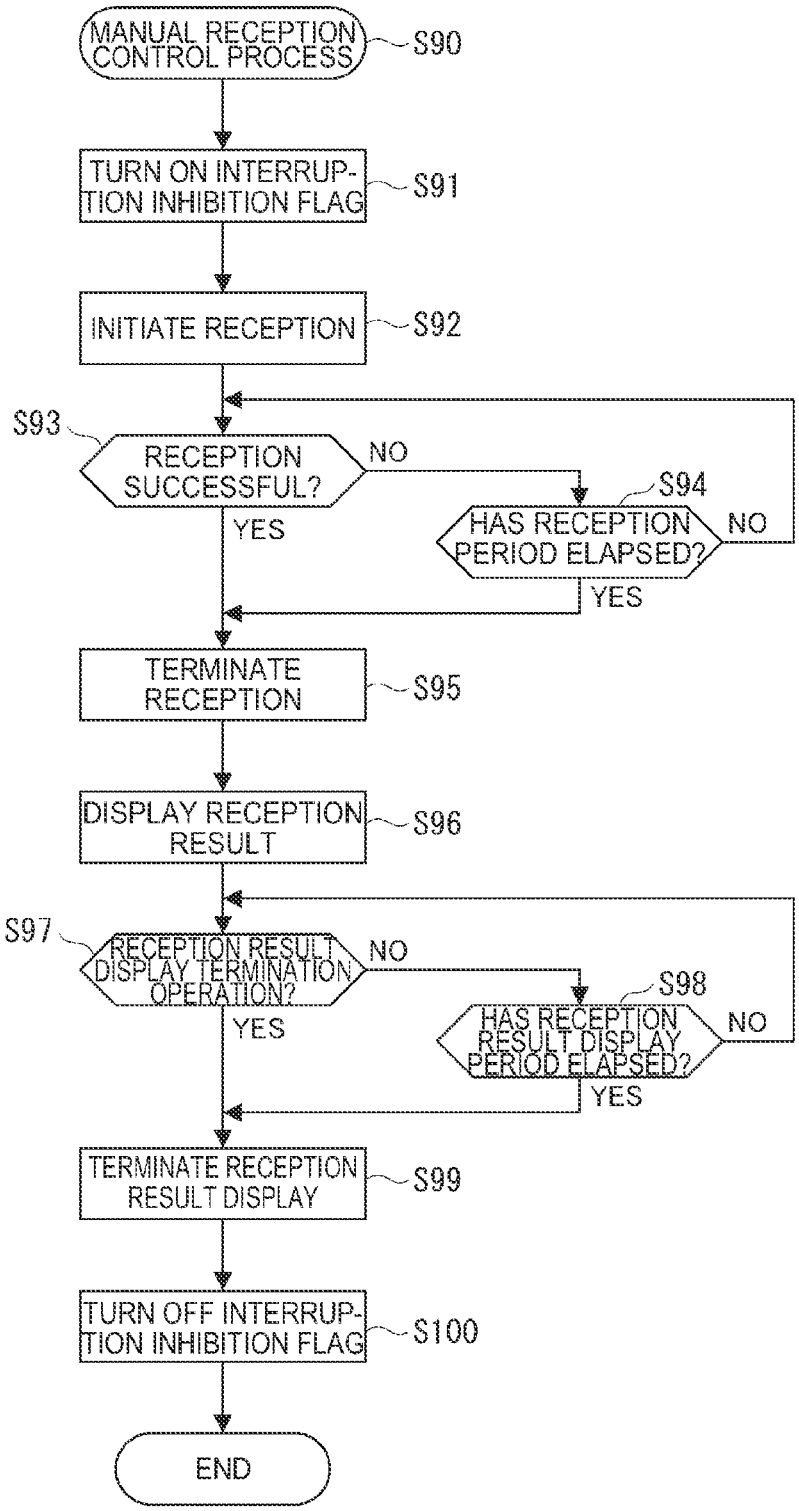
FIG. 9 is a flowchart showing a manual reception control process in the control process.

The action control section 340 first enables (turns on) an interrupt inhibition flag that inhibits interruption made by other processes (S91), as shown in FIG. 9.

The manual reception control section 312 then activates the reception device 121 to cause it to initiate the satellite signal reception process (S92).

The manual reception control section 312 then evaluates whether a satellite signal has been successfully received in the reception process and the time information has been acquired (S93).

When the evaluation result in S93 is NO, the manual reception control section 312 evaluates whether the preset reception period has elapsed since the initiation of the reception process (S94).

When the evaluation result in S94 is NO, the manual reception control section 312 returns the control to the process in S93. That is, except a case where a satellite signal has been successfully received and the evaluation result in S93 is therefore YES, the evaluation processes in S93 and S94 are repeatedly carried out until the reception period described above elapses.

When the evaluation result in S93 is YES or when the evaluation result in S94 is YES, the manual reception control section 312 terminates the satellite signal reception process (S95).

The manual reception control section 312 then carries out the reception result display process to cause the display device 141 to display a result of the satellite signal reception (S96).

The manual reception control section 312 then evaluates whether input operation that terminates the reception result display process has been performed (whether B button 62 has been pressed) (S97).

When the evaluation result in S97 is NO, the manual reception control section 312 evaluates whether the preset display period has elapsed since the initiation of the reception result display process (S98).

When the evaluation result in S98 is NO, the manual reception control section 312 returns the control to the process in S97. That is, except a case where input operation that terminates the reception result display process has been performed and the evaluation result in S97 is therefore YES, the evaluation processes in S97 and S98 are repeatedly carried out until the display period described above elapses.

When the evaluation result in S97 is YES or when the evaluation result in S98 is YES, the manual reception control section 312 terminates the reception result display process (S99).

The action control section 340 then disables (turns off) the interrupt inhibition flag (S100). The control device 300 then terminates the manual reception control process S90.

Referring back to FIG. 7, after the automatic reception control process S70 or the manual reception control process S90, when a satellite signal has been successfully received and the time information has been acquired in S70 or S90, the time correction section 315 corrects the received time data 211 based on the acquired time information. The internal time data 213 and the timepiece displayed time data 214 are therefore also corrected (S22). The control device 300 then terminates the reception control process S2.

Chronograph Control Process

The chronograph control process S4 will next be described.

Figure 10:
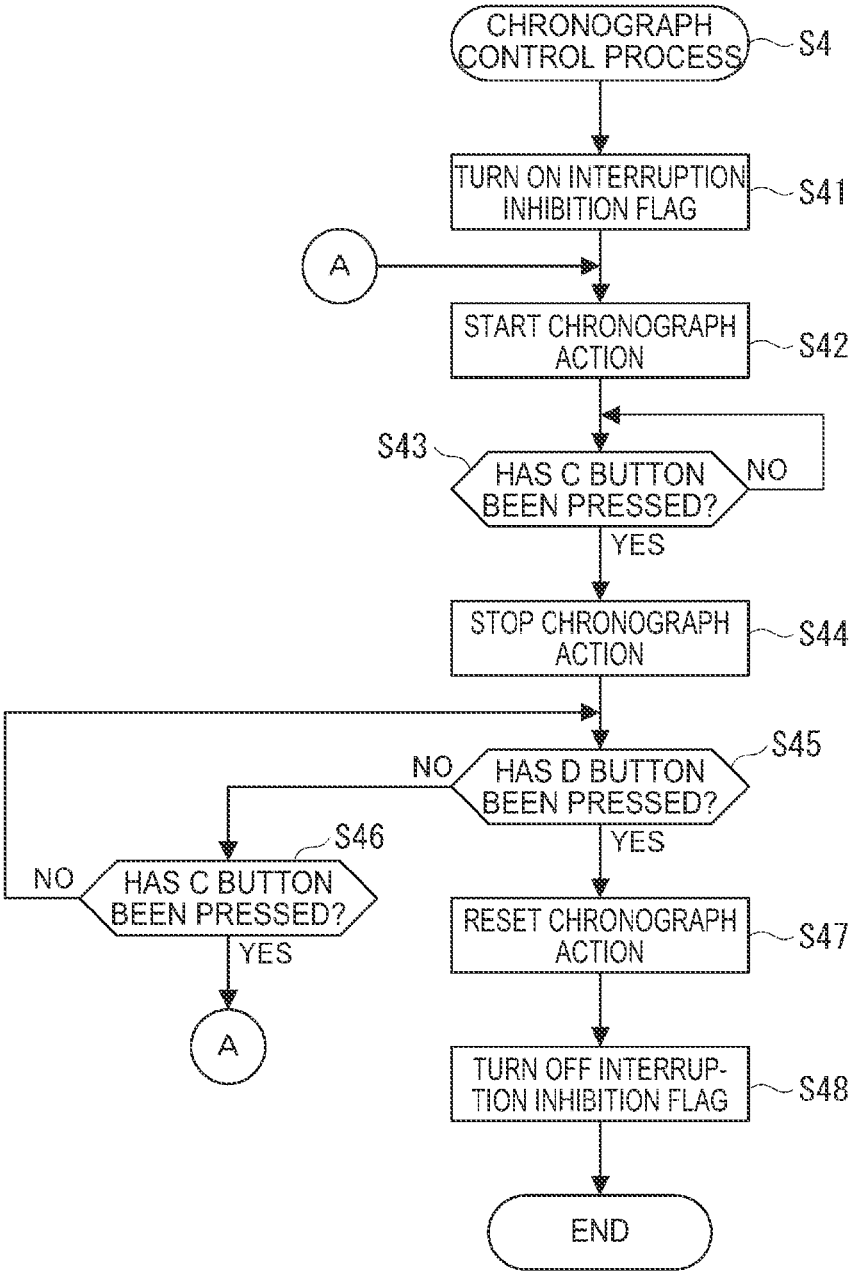
FIG. 10 is a flowchart showing a chronograph control process in the control process.

The action control section 340 first turns on the interrupt inhibition flag (S41), as shown in FIG. 10.

The chronograph section 320 then starts the chronograph action (S42).

The chronograph section 320 then evaluates whether the C button 63 has been pressed (S43).

When the evaluation result in S43 is NO, the chronograph section 320 repeats the evaluation process in S43.

On the other hand, when the evaluation result in S43 is YES, the chronograph section 320 stops the chronograph action (S44). That is, S42 to S44 form the time measurement step in an embodiment of the invention.

The chronograph section 320 then evaluates whether the D button 64 has been pressed (S45).

When the evaluation result in S45 is NO, the chronograph section 320 evaluates whether the C button 63 has been pressed (S46).

When the evaluation result in S46 is NO, the chronograph section 320 returns the control to the process in S45. On the other hand, when the evaluation result in S46 is YES, the chronograph section 320 returns the control to the process in S42 and starts the chronograph action again.

On the other hand, when the evaluation result in S45 is YES, the chronograph section 320 resets the chronograph action (S47).

The action control section 340 then turns off the interrupt inhibition flag (S48). The control device 300 then terminates the chronograph control process S4.

Predetermined Function Control Process

The predetermined function control process S6 will next be described.

The action control section 340 first turns on the interrupt inhibition flag.

One of the reception result display function section 331, the leap second reception result display function section 332, and the automatic reception selection function section 333 in the predetermined function section 330 is then activated in accordance with input operation.

Specifically, when the B button 62 is pressed for a period shorter than 3 seconds, the reception result display function section 331 is activated. When the B button 62 is pressed for a period shorter than 3 seconds and then pressed once again, the leap second reception result display function section 332 is activated. When the A button 61 and the B button 62 are pressed at the same time for a period longer than or equal to 3 seconds, the automatic reception selection function section 333 is activated.

When an instruction that terminates the action of each of the function sections 331 to 333 is issued, for example, through button operation, the action control section 340 turns off the interrupt inhibition flag. The control device 300 then terminates the predetermined function control process S6.

Advantageous Effects Provided by First Embodiment

According to the electronic timepiece 10 in the first embodiment described above, the following advantageous effects are provided.

That is, when input operation that initiates the chronograph action is performed during the satellite signal reception process carried out by the automatic reception control section 311, the action control section 340 terminates the satellite signal reception process in S75 and performs the chronograph action.

As a result, the satellite signal reception process and the chronograph action are not performed at the same time, whereby a decrease in the battery voltage in the electronic timepiece 10 or a decrease in the processing ability thereof can be suppressed, and the chronograph section 320 can act correctly. The chronograph action can therefore be reliably performed in accordance with input operation for improvement in usability.

Further, since the reception process carried out by the automatic reception control section 311 is automatically carried out without user's operation, the chronograph action, which is performed based on input operation, has higher priority, whereby the electronic timepiece 10 acts in accordance with user's intention for further improvement in usability.

When input operation that initiates the chronograph action is performed during the reception result display process carried out by the automatic reception control section 311, the action control section 340 terminates the reception result display process in S83 and performs the chronograph action, whereby the chronograph action can be reliably performed in accordance with input operation. Further, since a reception result and a chronograph measurement result can be displayed by using the same indication hand 91, the number of parts can be reduced and the size of the electronic timepiece 10 can be reduced as compared with a case where separate indication hands are used to display the results.

The manual reception process is carried out when the B button 62 is pressed for a period longer than or equal to 3 seconds, whereas the chronograph action is performed when the C button 63 is pressed for even a short period. The manual reception process is therefore unlikely to be initiated accidentally through wrong button operation. When input operation that initiates the chronograph action is performed during the manual reception process carried out in response to input operation, the chronograph action input operation is likely to have been performed by user's accidental button operation.

In the present embodiment, even when input operation that initiates the chronograph action is performed during execution of the manual reception process, the interrupt inhibition flag that has been turned ON allows the manual reception process to continue but prevents the chronograph action from being performed, whereby the electronic timepiece 10 will not act against user's intention.

When input operation that initiates the chronograph action is performed during the execution of the fixed-time automatic reception process and the reception process is therefore terminated, the reception process can then be carried out after a period shorter than the predetermined period described above, whereby the reception interval will not be greatly longer (twice or further longer, for example) than the predetermined period.

Even when the automatic reception condition is satisfied or input operation that initiates the manual reception process is performed during the chronograph action, the interrupt inhibition flag that has been turned on allows the chronograph action to continue and prevents the reception process from being initiated. The electronic timepiece 10 will therefore not act against user's intention.

Even when input operation that initiates the chronograph action is detected during execution of any of the predetermined functions performed by the predetermined function section 330, the interrupt inhibition flag that has been turned on allows the predetermined function to continue and prevents the chronograph action from being performed. The electronic timepiece 10 will therefore not act against user's intention.

Further, the action of the predetermined function section 330 is terminated based on input operation that terminates the action of the predetermined function section 330. Therefore, even when the predetermined function section 330 is in action, and the user desires to initiate the chronograph action and performs relevant input operation, the user can immediately terminate the action of the predetermined function section 330 and can perform the chronograph action, whereby the usability can be improved.

Second Embodiment

A second embodiment of the invention will next be described.

An electronic timepiece according to the second embodiment differs from the electronic timepiece 10 according to the first embodiment in terms of the automatic reception control process. The other points are the same as those in the first embodiment and will therefore not be described.

Figure 11:
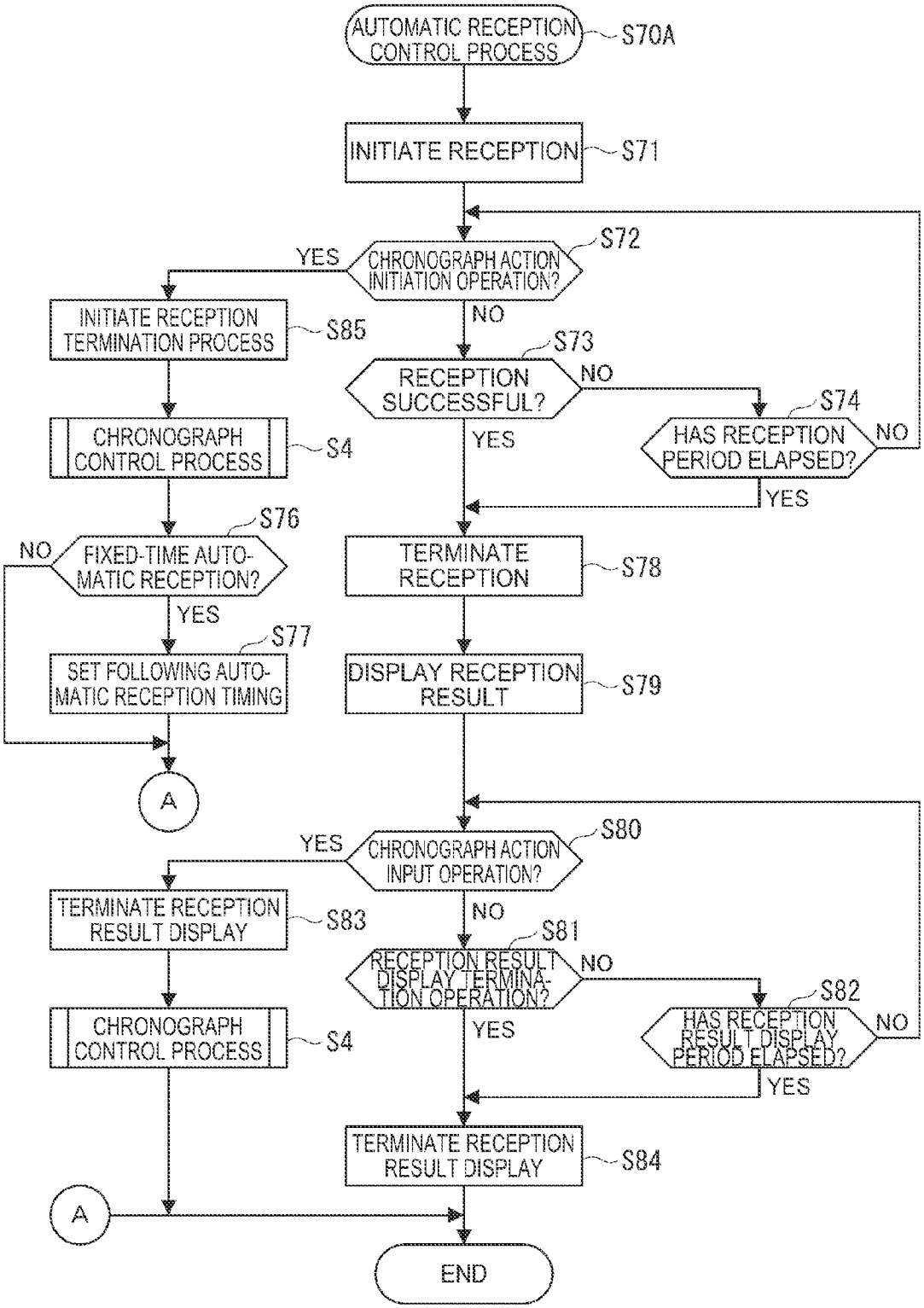
FIG. 11 is a flowchart showing an automatic reception control process according to a second embodiment of the invention.

FIG. 11 is a flowchart showing an automatic reception control process in the second embodiment.

Steps S4, S71 to S74, and S76 to S84 in an automatic reception control process S70A in the second embodiment are the same as those in the automatic reception control process S70 in the first embodiment and will therefore not be described.

In the second embodiment, when the evaluation result in S72 is YES, the action control section 340 causes the automatic reception control section 311 to initiate a reception termination process of terminating the reception process (S85). The action control section 340 then carries out the chronograph control process S4 in S4.

It is noted that it takes, for example, 100 msec from the initiation of the reception termination process to the termination of the reception process.

That is, in the first embodiment, the chronograph control process S4 is initiated after the reception process is terminated, whereas in the second embodiment, the chronograph control process S4 is initiated before the reception process is terminated and hence during the action of the reception device 121.

Advantageous Effect Provided by Second Embodiment

Since the action control section 340 causes the automatic reception control section 311 to initiate the reception termination process of terminating the reception process and then allows the chronograph action to be performed, the chronograph action can be quickly performed in response to input operation that initiates the chronograph action as compared with the case where the chronograph action is performed after the reception process is completed as in the first embodiment, whereby the usability can be improved.

In the first embodiment, since the chronograph action is performed after the reception process is terminated, it is possible to reliably prevent the reception process and the chronograph action from being performed at the same time, whereas in the second embodiment, the reception process and the chronograph action are performed at the same time although for a short period. After the reception termination process is initiated, however, process burden lowers as compared with that in the period before the reception termination process is initiated, whereby incorrect chronograph action is unlikely to occur due to a decrease in the processing ability also in the second embodiment.

VARIATIONS

The invention is not limited to the embodiments described above, and changes, improvements, and other modifications to the extent that the advantage of the invention is achieved fall within the scope of the invention.

In the embodiments described above, even when input operation that initiates the chronograph action is detected during the execution of the manual reception process, the manual reception process is allowed to continue and the chronograph action is not allowed to be performed, but the invention is not necessarily configured this way. That is, the manual reception process may be terminated and the chronograph action may be performed. That is, after the reception process is terminated or after the reception termination process of terminating the reception process is initiated, the chronograph action may be performed. In this case, even when the reception process is performed in response to input operation, but when the user desires to initiate the chronograph action and performs relevant input operation, the chronograph action can be quickly performed in response to input operation that initiates the chronograph action without separately performing input operation that terminates the reception process, whereby the usability can be improved. In this case, the manual reception control section 312 in addition to the automatic reception control section 311 forms the reception control section in an embodiment of the invention.

Further, consider a case where when input operation that initiates the chronograph action is detected during the execution of the manual reception process, the manual reception process is terminated and the chronograph action is performed. In this case, when input operation that initiates the chronograph action is detected during the execution of the automatic reception process, the automatic reception process may be allowed to continue but the chronograph action may not be performed. In this case, the manual reception control section 312 forms the reception control section in an embodiment of the invention, but the automatic reception control section 311 does not form the reception control section in the embodiment of the invention.

In the embodiments described above, even when input operation that initiates the chronograph action is detected during the action of the predetermined function section 330, the action of the predetermined function section 330 is allowed to continue but the chronograph action is not allowed to be performed, but the invention is not necessarily configured this way. That is, the action of the predetermined function section 330 may be terminated, and the chronograph action may be performed. In this case, even when the predetermined function section 330 is in action, but when the user desires to initiate the chronograph action and performs relevant input operation, the action of the predetermined function section 330 can be immediately terminated and the chronograph action can be performed without separately performing input operation that terminates the action of the predetermined function section 330, whereby the usability can be improved.

In the embodiments described above, when the automatic reception condition is satisfied or input operation that initiates the manual reception process is performed and an instruction that initiates satellite signal reception is therefore issued during the chronograph action, no satellite signal reception is initiated even after the chronograph action is terminated, but the invention is not necessarily configured this way. That is, after the chronograph action is terminated, a satellite signal may be received. In this case, after the chronograph action is terminated, a satellite signal can be quickly received automatically.

In the embodiments described above, the time measurement section in an embodiment of the invention is formed of the chronograph section 320, but the invention is not necessarily configured this way. That is, the time measurement section may be a timer that measures time in a countdown scheme from preset timing.

In the embodiments described above, the automatic reception control section 311 carries out the automatic reception process in the timing mode. The automatic reception control section 311 may carry out the automatic reception process in the positioning mode in addition to the timing mode.

In the embodiments described above, the reception timing in the fixed-time automatic reception process is set every third day by way of example. The reception timing may instead be set every day.

In this case, the process of setting the following reception timing carried out when the reception process is the fixed-time automatic reception process in S76 and S77 in the automatic reception control process S70 is omitted.

The GPS satellites 8 have been described as an example of the positional information satellite, but the positional information satellite is not limited to the GPS satellites 8 and may be a satellite used in any other global navigation satellite system (GNSS), such as Galileo (EU), GLONASS (Russia), and Beidou (China). Further, a satellite-based augmentation system (SBAS) or any other stationary satellite, a regional navigation satellite system (RNSS) capable of searching only in a specific region, such as a quasi-zenith satellite, and other satellites can be used.

In the embodiments described above, the predetermined function section 330 includes the reception result display function section 331, the leap second reception result display function section 332, and the automatic reception selection function section 333, but the invention is not necessarily configured this way.

For example, the predetermined function section 330 may include an alarm setting portion, an alarm display portion, a timer setting portion, a timer display portion, an illumination setting portion, an in-airplane mode setting portion, and a small timepiece setting portion, each of which is activated based on input operation performed on the input device 157.

When the electronic timepiece 10 has an alarm function of emitting an alarm sound, the alarm setting portion and the alarm display portion are provided.

The alarm setting portion sets, for example, the initiation time when the alarm sound is emitted, the period for which the alarm sound is being emitted (sound emission period), and the magnitude of the alarm sound in accordance with button operation. In this process, the alarm setting portion, for example, moves a predetermined indication hand, such as the indication hand 21, to indicate the initiation time, the sound emission period, and the magnitude of the alarm sound.

The alarm display portion moves, when the alarm function is turned on, a predetermined indication hand in response to button operation to indicate, for example, the initiation time, the sound emission period, and the magnitude of the alarm sound set by the alarm setting portion.

When the electronic timepiece 10 has a timer function, the timer setting portion and the timer display portion are provided.

The timer setting portion sets the time countdown action is executed (such as 5 minutes, 30 minutes, and 1 hour) in accordance with button operation. In this process, the timer setting portion moves a predetermined indication hand to indicate the timing.

The timer display portion moves, when the timer function is turned on, a predetermined indication hand in response to button operation to indicate the remaining period in the countdown action.

When the electronic timepiece 10 has an illumination function, the illumination setting portion is provided.

The illumination setting portion sets, for example, the illuminance of the illumination and an illumination period (period over which illumination continues) per operation in accordance with button operation. In this process, the illumination setting portion moves a predetermined indication hand to indicate the illuminance and the illumination period.

The in-airplane setting portion switches the in-airplane mode between ON and OFF in accordance with the operation of the A button 61. In this process, the in-airplane setting portion moves the indication hand 91 to indicate the position showing the in-airplane mode ON (position of symbol 93 in FIG. 2) or the position showing the in-airplane mode OFF (position other than symbol 93).

When the electronic timepiece 10 includes a small timepiece capable of displaying time different from the current time in another region, the small timepiece setting portion is provided.

The small timepiece setting portion sets the time displayed by the small timepiece in accordance with button operation. In this process, the small timepiece setting portion moves an indication hand of the small timepiece to indicate the set time.

The entire disclosure of Japanese Patent Application Nos. 2014-57393, filed Mar. 20, 2014 and 2014-151065, filed Jul. 24, 2014 are expressly incorporated by reference herein.

What is claimed is:

1. An electronic timepiece comprising:

a reception device that receives a satellite signal;

an automatic reception control section that is configured to automatically activate the reception device to carry out a reception process;

a time measurement section that measures time;

an input device;

an action control section that, when detecting time measurement input operation performed on the input device for activating the time measurement section during the reception process carried out by the automatic reception control section, terminates the action of the automatic reception control section, and activates the time measurement section; and a manual reception control section that activates the reception device to carry out the reception process in accordance with input operation performed on the input device, wherein the action control section, even when detecting the time measurement input operation during the reception process carried out by the manual reception control section, allows the action of the manual reception control section to continue without activating the time measurement section.

2. The electronic timepiece according to claim 1, further comprising a display device, wherein the automatic reception control section, after terminating the reception process, carries out a reception result display process to cause the display device to display a result of the reception, and the action control section, when detecting the time measurement input operation during the reception result display process carried out by the automatic reception control section, terminates the action of the automatic reception control section and activates the time measurement section.

3. The electronic timepiece according to claim 1, wherein the automatic reception control section activates the reception device to carry out the reception process when an automatic reception condition under which the satellite signal is automatically received is satisfied.

4. The electronic timepiece according to claim 1, wherein the automatic reception control section is activated when automatic reception timing is reached, the automatic reception timing is set at predetermined intervals, and the action control section, when detecting the time measurement input operation during the reception process carried out by the automatic reception control section after the automatic reception timing is reached, terminates the action of the automatic reception control section and sets the following automatic reception timing in such a way that the automatic reception is performed after a period shorter than the predetermined interval.

5. The electronic timepiece according to claim 1, wherein the action control section, even when detecting an instruction that initiates the reception process during the action of the time measurement section, allows the action of the time measurement section to continue but does not allow the reception process to start.

6. The electronic timepiece according to claim 5, wherein the action control section, when detecting the instruction that initiates the reception process during the action of the time measurement section, allows the reception process to start after the action of the time measurement section is completed.

7. The electronic timepiece according to claim 1, further comprising a predetermined function section that performs a predetermined function in accordance with input operation performed on the input device, wherein the action control section, even when detecting the time measurement input operation during the action of the predetermined function section, allows the action of the predetermined function section to continue without activating the time measurement section, and the predetermined function section terminates the action thereof in response to input operation performed on the input device for terminating the action of the predetermined function section.

8. The electronic timepiece according to claim 7, wherein the predetermined function section is at least one of a reception result display function section that displays a result of reception of the satellite signal, a leap second reception result display function section that displays a result of reception of leap second information contained in the satellite signal, and an automatic reception selection function section that selects whether the function of the automatic reception control section is enabled or disabled.

9. The electronic timepiece according to claim 1, further comprising a predetermined function section that performs a predetermined function in accordance with input operation performed on the input device, wherein the action control section, when detecting the time measurement input operation during the action of the predetermined function section, terminates the action of the predetermined function section and activates the time measurement section.

10. The electronic timepiece according to claim 1, wherein the reception control section is a manual reception control section that activates the reception device to carry out the reception process in accordance with input operation performed on the input device, and the action control section, when detecting the time measurement input operation during the reception process carried out by the manual reception control section, terminates the action of the manual reception control section and activates the time measurement section.

11. An electronic timepiece comprising:

a reception device that receives a satellite signal;

a reception control section configured to activate the reception device to carry out a reception process;

a time measurement section that measures time;

an input device; and an action control section, when detecting the time measurement input operation during the reception process carried out by the reception control section, activates the time measurement section after causing the reception control section to initiate a reception termination process of terminating the reception process and before the reception termination process is completed.

12. An electronic timepiece comprising:

a reception device that receives a satellite signal;

an automatic reception control section that is configured to automatically activate the reception device to carry out a reception process;

a time measurement section that measures time;

an input device; and an action control section that, when detecting time measurement input operation performed on the input device for activating the time measurement section during the reception process carried out by the automatic reception control section, terminates the action of the automatic reception control section, and activates the time measurement section, wherein the automatic reception control section is activated when automatic reception timing is reached, the automatic reception timing is set at predetermined intervals, and the action control section, when detecting the time measurement input operation during the reception process carried out by the automatic reception control section after the automatic reception timing is reached, terminates the action of the automatic reception control section and sets the following automatic reception timing in such a way that the automatic reception is performed after a period shorter than the predetermined interval.

13. The electronic timepiece according to claim 12, wherein the automatic reception control section activates the reception device to carry out the reception process when an automatic reception condition under which the satellite signal is automatically received is satisfied.

14. An electronic timepiece comprising:

a reception device that receives a satellite signal;

a reception control section that is configured to activate the reception device to carry out a reception process;

a time measurement section that measures time;

an input device;

an action control section that, when detecting time measurement input operation performed on the input device for activating the time measurement section during the reception process carried out by the reception control section, terminates the action of the reception control section, and activates the time measurement section; and a predetermined function section that performs a predetermined function in accordance with input operation performed on the input device, wherein the action control section, even when detecting the time measurement input operation during the action of the predetermined function section, allows the action of the predetermined function section to continue without activating the time measurement section, and the predetermined function section terminates the action thereof in response to input operation performed on the input device for terminating the action of the predetermined function section.

15. The electronic timepiece according to claim 14, wherein the predetermined function section is at least one of a reception result display function section that displays a result of reception of the satellite signal, a leap second reception result display function section that displays a result of reception of leap second information contained in the satellite signal, and an automatic reception selection function section that selects whether the function of the automatic reception control section is enabled or disabled.

* * * * *